US008592117B2

(12) United States Patent
Sugimoto et al.

(10) Patent No.: US 8,592,117 B2
(45) Date of Patent: Nov. 26, 2013

(54) TONER AND DEVELOPER

(75) Inventors: Tsuyoshi Sugimoto, Shizuoka (JP); Hiroshi Yamashita, Shizuoka (JP); Daisuke Asahina, Shizuoka (JP); Masaki Watanabe, Shizuoka (JP); Satoyuki Sekiguchi, Shizuoka (JP); Rintaro Takahashi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 4 days.

(21) Appl. No.: 13/336,318

(22) Filed: Dec. 23, 2011

(65) Prior Publication Data

US 2012/0189951 A1 Jul. 26, 2012

(30) Foreign Application Priority Data

Jan. 24, 2011 (JP) ..... 2011-011624
Nov. 29, 2011 (JP) ..... 2011-260175

(51) Int. Cl.
*G03G 9/00* (2006.01)

(52) U.S. Cl.
USPC ..... 430/108.4; 430/108.2; 430/109.1; 430/123.52; 430/123.54

(58) Field of Classification Search
USPC ..... 430/108.2, 108.4, 109.1, 123.52, 430/123.54
See application file for complete search history.

(56) References Cited

U.S. PATENT DOCUMENTS

| | | | | |
|---|---|---|---|---|
| 2008/0187854 | A1* | 8/2008 | Yoshida et al. | 430/109.4 |
| 2011/0171574 | A1* | 7/2011 | Hara et al. | 430/137.11 |
| 2011/0223532 | A1 | 9/2011 | Sugimoto et al. | |

FOREIGN PATENT DOCUMENTS

| | | |
|---|---|---|
| JP | 2579150 | 11/1996 |
| JP | 11-133665 | 5/1999 |
| JP | 2001-158819 | 6/2001 |
| JP | 2002-287400 | 10/2002 |
| JP | 2002-351143 | 12/2002 |
| JP | 2004-46095 | 2/2004 |
| JP | 2007-271789 | 10/2007 |
| JP | 2011-186295 | 9/2011 |

* cited by examiner

*Primary Examiner* — Thorl Chea
(74) *Attorney, Agent, or Firm* — Oblon, Spivak, McClelland, Maier & Neustadt, L.L.P.

(57) ABSTRACT

A toner including: a binder resin component; crystal nucleating agent; releasing agent; and colorant, wherein the binder resin component contains a crystalline polyester resin and a non-crystalline polyester resin, the crystal nucleating agent is at least one of an aliphatic ester compound and an aliphatic amide compound each having a melting point of 60° C. or higher but lower than 150° C., and wherein the toner satisfies Expressions (I) and (II):

$$Tc > Tp + 10 \quad \text{Expression (I)}$$

$$Tm > Tp + 2 \quad \text{Expression (II)}$$

where Tp denotes lowest exothermic peak temperature [° C.] in 0° C. to 200° C. in DSC curve obtained DSC of the crystalline polyester resin, Tc denotes lowest exothermic peak temperature [° C.] in 0° C. to 200° C. in DSC curve obtained DSC of the crystal nucleating agent, and Tm denotes lowest exothermic peak temperature [° C.] in 0° C. to 200° C. in DSC curve through DSC of the mixture of the crystalline polyester resin and the crystal nucleating agent.

12 Claims, No Drawings

TONER AND DEVELOPER

BACKGROUND OF THE INVENTION

1. Field of the Invention

The present invention relates to a toner and a developer, specifically to a toner which has excellent fixability and heat resistance storage stability and which can be suppressed in the occurrence of filming.

2. Description of the Related Art

In recent years, toners have been required to have the following: small particle diameters for forming high-quality images; low temperature fixability for hot offset resistance and energy saving; and heat resistance storage stability durable to high-humidity, high-temperature conditions during storage and transportation after production. In particular, it is quite important to improve low temperature fixability, since the power consumption upon fixing accounts for most of the total power consumption in the image forming process.

Conventionally, there have been used toners produced by the kneading pulverizing method. These toners are difficult to have small particle diameters, and their shapes are indefinite and their particle size distribution is broad. Thus, the toners produced by the kneading pulverizing method cannot form images having satisfactory quality and problematically require high energy for fixing. Also, when toner materials including wax (releasing agent) for improving fixing ability are used to produce a toner by the kneading-pulverizing method, cracks occur at the interfaces of the wax during pulverization, resulting in that the wax exists on the toner surface in a large amount. As a result, although the releasing effects can be obtained, toner adhesion to a carrier (filming), a photoconductor and a blade is likely to occur. The properties of such toners are not satisfactory in total.

In order to overcome the above-described problems the kneading-pulverizing method has, there is proposed a method for producing a toner by the polymerization method. According to the polymerization method, toners are made easily to have a small particle diameter. Their particle size distribution is sharper than that of the toners obtained by the pulverizing method. Furthermore, the releasing agent can be embedded in the toner particles. As one exemplary polymerization method, Japanese Patent Application Laid-Open (JP-A) No. 11-133665 and other patent literatures disclose a method for producing a toner using, as a binder, an elongated product of a urethane-modified polyester for the purposes of improving low-temperature fixing ability and hot offset resistance of toner.

Also, JP-A Nos. 2002-287400 and 2002-351143 and other patent literatures disclose a production method for a toner having excellent fluidity and transferability as powder with a small particle diameter as well as being excellent in heat resistant storage stability, low-temperature fixing ability and hot offset resistance.

Japanese Patent (JP-B) No. 2579150 and JP-A No. 2001-158819 disclose a toner production method including an aging step for producing a toner binder having a more uniform molecular weight distribution and for attaining both desired low-temperature fixing ability and desired offset resistance.

None of these proposed techniques meet such a high level of low temperature fixability that has recently been required.

In order to produce a toner having a high level of low temperature fixability, there has been proposed a toner including: a resin containing a crystalline polyester resin; and a releasing agent, wherein the resin and the wax are not in a compatible state to form a phase-separated, sea-island structure (for example, JP-A No. 2004-46095).

Also, there has been proposed a toner containing a crystalline polyester resin, a releasing agent and a graft polymer (for example, JP-A No. 2007-271789).

These proposed techniques can produce toners having good heat resistance storage stability, good hot offset resistance, and a high level of low temperature fixability. However, the crystalline polyester resin and the releasing agent are not sufficiently dispersed in the toners, causing filming.

Furthermore, the toners containing the crystalline polyester are excellent in low temperature fixability but poor in blocking property of the toner image after fixing. When printed matter having toner image is stored at high temperatures, the image tends to melt to be peeled off, which is problematic.

Thus, at present, demand has arisen for a toner which involves no filming and which has excellent low temperature fixability, hot offset resistance, heat resistance storage stability, and blocking resistance of the toner image after fixing; and a developer containing the toner.

BRIEF SUMMARY OF THE INVENTION

The present invention aims to solve the above existing problems and achieve the following objects.

That is, an object of the present invention is to provide a toner which involves no filming and which has excellent low temperature fixability, hot offset resistance, heat resistance storage stability, and blocking resistance of the toner image after fixing; and a developer containing the toner.

Means for solving the above existing problems are as follows.

<1> A toner including:

a binder resin component;

a crystal nucleating agent;

a releasing agent; and a colorant, wherein the binder resin component contains a crystalline polyester resin and a non-crystalline polyester resin, wherein the crystal nucleating agent is at least one selected from the group consisting of an aliphatic ester compound having a melting point of 60° C. or higher but lower than 150° C. and an aliphatic amide compound having a melting point of 60° C. or higher but lower than 150° C., and wherein the toner satisfies the following expressions (I) and (II):

$$Tc > Tp + 10 \quad \text{Expression (I)}$$

$$Tm > Tp + 2 \quad \text{Expression (II)}$$

where Tp denotes the lowest exothermic peak temperature [° C.] in a range of 0° C. to 200° C. in a differential scanning calorimetry (DSC) curve obtained through DSC of the crystalline polyester resin, Tc denotes the lowest exothermic peak temperature [° C.] in a range of 0° C. to 200° C. in a DSC curve obtained through DSC of the crystal nucleating agent, and Tm denotes the lowest exothermic peak temperature [° C.] in a range of 0° C. to 200° C. in a DSC curve obtained through DSC of the mixture of the crystalline polyester resin and the crystal nucleating agent.

<2> The toner according to <1>, wherein the toner satisfies the following expressions (I) and (II'):

$$Tc > Tp + 10 \quad \text{Expression (I)}$$

$$Tm > Tp + 5 \quad \text{Expression (II')}$$

<3> The toner according to <1>, wherein the crystal nucleating agent is the aliphatic amide compound having a melting point of 60° C. or higher but lower than 150° C.

<4> The toner according to <1>, wherein the toner is obtained by a method including:

dispersing, in an aqueous medium, an oil phase containing the binder resin component, the crystal nucleating agent, the releasing agent and the colorant in an organic solvent, to prepare a dispersion liquid; and removing the organic solvent from the dispersion liquid.

<5> The toner according to <4>, wherein a solubility at 70° C. of the crystal nucleating agent to the organic solvent is 5% by mass or more and a solubility at 25° C. of the crystal nucleating agent to the organic solvent is 0.5% by mass or less.

<6> The toner according to any one of <1> to <5>, wherein the melting point of the crystal nucleating agent is 70° C. or higher but lower than 120° C.

<7> The toner according to any one of <1> to <6>, wherein the crystalline polyester resin has a constituent unit derived from a saturated aliphatic dicarboxylic acid and a constituent unit derived from a saturated aliphatic diol.

<8> The toner according to any one of <1> to <7>, wherein the crystalline polyester resin has a melting point of 60° C. or higher but lower than 80° C.

<9> The toner according to any one of <1> to <8>, wherein the toner has a glass transition temperature (Tg1st) of 20° C. or higher but lower than 60° C., where the glass transition temperature (Tg1st) is measured at the first temperature raising in DSC.

<10> The toner according to any one of <1> to <9>, wherein the toner has a glass transition temperature (Tg2nd) of 10° C. or higher but lower than 30° C., where the glass transition temperature (Tg2nd) is measured at the second temperature raising in DSC.

<11> The toner according to any one of <1> to <10>, wherein soluble matter of the crystalline polyester resin in o-dichlorobenzene has a weight average molecular weight (Mw) of 3,000 to 30,000, a number average molecular weight (Mn) of 1,000 to 10,000, and a ratio Mw/Mn of 1.0 to 10, where the weight average molecular weight (Mw) and the number average molecular weight (Mn) are measured through gel permeation chromatography (GPC).

<12> The toner according to any one of <1> to <11>, wherein the toner is obtained by a method including:

dissolving or dispersing, in the organic solvent, an active hydrogen group-containing compound serving as a precursor of the binder resin component, a polymer containing a site reactive with the active hydrogen group-containing compound serving as another precursor of the binder resin component, the crystalline polyester resin, the non-crystalline polyester resin, the crystal nucleating agent, the releasing agent and the colorant, to thereby prepare an oil phase;

dispersing the oil phase in an aqueous medium to prepare a dispersion liquid and allowing, in the dispersion liquid, the active hydrogen group-containing compound and the polymer containing a site reactive with the active hydrogen group-containing compound to undergo crosslinking reaction or elongating reaction or both of the crosslinking reaction and the elongating reaction; and removing the organic solvent from the dispersion liquid.

<13> A developer including:

the toner according to any one of <1> to <12>.

The present invention can provide a toner which involves no filming and which has excellent low temperature fixability, hot offset resistance, heat resistance storage stability, and blocking resistance of the toner image after fixing; and a developer containing the toner.

DETAILED DESCRIPTION OF THE INVENTION

Toner

A toner of the present invention contains: at least a binder resin component, a releasing agent, a crystal nucleating agent and a colorant; and, if necessary, further contains other ingredients.

The toner is preferably a toner produced by a method including: dispersing, in an aqueous medium, an oil phase containing the binder resin component, the crystal nucleating agent, the releasing agent and the colorant in an organic solvent, to thereby prepare a dispersion liquid; and removing the organic solvent from the dispersion liquid.

<Binder Resin Component>

The binder resin component is, for example, a non-crystalline polyester resin and a crystalline polyester resin.

—Non-Crystalline Polyester Resin—

The non-crystalline polyester resin is produced using a polyhydric alcohol component and a polycarboxylic acid component such as a polycarboxylic acid, a polycarboxylic anhydride or a polycarboxylic acid ester.

Notably, in the present invention, the non-crystalline polyester resin refers to a product obtained as described above using the polyhydric alcohol component and the polycarboxylic acid component such as the polycarboxylic acid, the polycarboxylic anhydride or the polycarboxylic acid ester. The non-crystalline polyester resin does not encompass modified polyester resins such as the below-described prepolymers and resins obtained through crosslinking and/or elongating reaction of the prepolymers.

Examples of the polyhydric alcohol component include adducts of bisphenol A with alkylene oxides (having 2 or 3 carbon atoms) (average addition mole number: 1 to 10) such as polyoxypropylene(2.2)-2,2-bis(4-hydroxyphenyl)propane and polyoxyethylene(2.2)-2,2-bis(4-hydroxyphenyl)propane; ethylene glycol, propylene glycol, neopentyl glycol, glycerin, pentaerythritol, trimethylol propane, hydrogenated bisphenol A, sorbitol and adducts of them with alkylene oxides (having 2 or 3 carbon atoms) (average addition mole number: 1 to 10). These may be used alone or in combination.

Examples of the polyhydric carboxylic acid component include dicarboxylic acids such as adipic acid, phthalic acid, isophthalic acid, terephthalic acid, fumaric acid and maleic acid; succinic acid substituted by a C1-C20 alkyl group or a C2-C20 alkenyl group such as dodecenyl succinic acid and octylsuccinic acid; trimellitic acid and pyromellitic acid; anhydrides and alkyl (having 1 to 8 carbon atoms) esters of these acids. These may be used alone or in combination.

The non-crystalline polyester resin is preferably in an at least partially compatible state with the below-described prepolymer and the resin obtained through crosslinking reaction and/or elongating reaction of the prepolymer. When they are in the partially compatible state, the formed toner can be increased in low-temperature fixability and hot offset resistance. Thus, preferably, the non-crystalline polyester resin and the below-described prepolymer are similar in their constituent polyhydric alcohol component and their constituent polycarboxylic acid component.

The molecular weight of the non-crystalline polyester resin is not particularly limited and may be appropriately selected depending on the intended purpose. When the molecular weight is too low, the formed toner may be poor in heat resistance storage stability and durability to stress such as stirring in the developing device. When the molecular weight is too high, the formed toner may be increased in viscoelasticity during melting, resulting in that it may be degraded in low-temperature fixability.

Preferably, through gel permeation chromatography or GPC, the unmodified polyester resin has a weight average molecular weight (Mw) of 3,000 to 15,000, a number average molecular weight (Mn) of 1,000 to 5,000, and a Mw/Mn of 1.0 to 4.0.

More preferably, the unmodified polyester resin has a weight average molecular weight (Mw) of 5,000 to 15,000, a number average molecular weight (Mn) of 1,500 to 5,000, and a Mw/Mn of 1.0 to 3.5.

(Gel Permeation Chromatography)

Gel permeation chromatography may be under any conditions so long as soluble matter in o-dichlorobenzene can be accurately measured for weight average molecular weight (Mw) and number average molecular weight (Mn). The values described herein are measured under the following measurement conditions.

<Measurement Conditions>

Gel permeation chromatography (GPC) measuring apparatus:

GPC-8220GPC (product of TOSOH CORPORATION)

Column: TSKgel Super HZM-H 15 cm, 3 columns connected (product of TOSOH CORPORATION)

Temperature: 40° C.

Solvent: o-Dichlorobenzene

Flow rate: 0.35 mL/min

Sample: 0.15% sample (0.4 mL) applied

Pretreatment of sample: A target sample is dissolved in o-dichlorobenzene in a concentration of 0.15% by mass, and the solution is filtrated with a 0.2-μm filter. The resultant filtrate is used as a measurement sample. This sample solution (100 μL) is applied for measurement.

In the measurement of the molecular weight of the sample, the molecular weight distribution of the sample is determined based on the relationship between the logarithmic value and the count number of a calibration curve given by using several monodisperse polystyrene-standard samples. The standard polystyrenes used for giving the calibration curve were Showdex STANDARD Std. Nos. S-7300, S-210, S-390, S-875, S-1980, S-10.9, S-629, S-3.0 and S-0.580 (these products are of SHOWA DENKO K.K.) and toluene. The detector used was a refractive index (RI) detector.

The acid value of the non-crystalline polyester resin is not particularly limited and may be appropriately selected depending on the intended purpose, but is preferably 1 mgKOH/g to 50 mgKOH/g, more preferably 5 mgKOH/g to 30 mgKOH/g. When the acid value thereof is 1 mgKOH/g or higher, it is easy for the toner to be negatively charged. Moreover, the affinity between toner and paper is increased upon fixing of the toner, which improves low-temperature fixability. Whereas when the acid value thereof is higher than 50 mgKOH/g, charge stability of the toner may be degraded, particularly depending on a change in the working environment.

The hydroxyl value of the non-crystalline polyester resin is not particularly limited and may be appropriately selected depending on the intended purpose, but is preferably 5 mgKOH/g or higher.

The glass transition temperature (Tg) of the non-crystalline polyester resin is not particularly limited and may be appropriately selected depending on the intended purpose. When the Tg is too low, the formed toner may be poor in heat resistance storage stability and durability to stress due to, for example, stirring in the developing device. When the Tg is too high, the formed toner may be increased in viscoelasticity during melting, resulting in that it may be degraded in low temperature fixability. Thus, the Tg is preferably 20° C. to 60° C., more preferably 30° C. to 50° C.

The amount of the non-crystalline polyester resin is not particularly limited and may be appropriately selected depending on the intended purpose, but is preferably 50% by mass to 95% by mass, more preferably 60% by mass to 90% by mass, relative to the amount of the toner. When it is less than 50% by mass, the colorant and the releasing agent are degraded in dispersibility in the toner, easily causing image fogging and image failure. When it is more than 95% by mass, the formed toner may be degraded in low-temperature fixability since the amount of the crystalline polyester resin becomes small. When it falls within the above more preferred range, the formed toner is excellent in any of image quality, stability and low temperature fixability, which is advantageous.

The molecular structure of the non-crystalline polyester resin can be confirmed, for example, by NMR (Nuclear Magnetic Resonance) measurement of the non-crystalline polyester resin in a solution or as a solid, as well as by measurement of the non-crystalline polyester resin using X-ray diffraction, GC/MS (Gas Chromatograph Mass Spectrometer), LC/MS (Liquid Chromatograph Mass Spectrometer), IR (Infrared Spectroscopy), etc. In the infrared absorption spectrum, the non-crystalline polyester resin may be detected on the basis of absorption at wavelengths of 965 $cm^{-1}$±10 $cm^{-1}$ and 990 $cm^{-1}$±10 $cm^{-1}$, which is based on an out-of-plane bending vibration (δCH) of an olefin.

—Crystalline Polyester Resin—

The crystalline polyester resin has high crystallinity and thus exhibits such a hot melt property that the viscosity is rapidly decreased in the vicinity of a temperature at which fixing is initiated. Use of this crystalline polyester resin provides a toner having both a good heat resistant storage stability and a good low temperature fixing ability, since the crystalline polyester resin exhibits a good heat resistant storage stability due to its crystallinity immediately before melting is initiated and is rapidly decreased in viscosity (sharp melt property) for fixing at a temperature at which melting is initiated. In addition, the toner containing this crystalline polyester resin has a suitable difference between the lower limit of the fixing temperature and the temperature at which hot offset occurs (i.e., a release range).

The crystalline polyester resin is produced using a polyhydric alcohol component and a polycarboxylic acid component such as a polycarboxylic acid, a polycarboxylic anhydride or a polycarboxylic acid ester.

Notably, in the present invention, the crystalline polyester resin refers to a product obtained as described above using the polyhydric alcohol component and the polycarboxylic acid component such as the polycarboxylic acid, the polycarboxylic anhydride or the polycarboxylic acid ester. The crystalline polyester resin does not encompass modified polyester resins such as the below-described prepolymers and resins obtained through crosslinking and/or elongating reaction of the prepolymers.

—Polyhydric Alcohol Component—

The polyhydric alcohol component is not particularly limited and may be appropriately selected depending on the intended purpose. Examples thereof include diols and trihydric or higher alcohols.

Examples of the diols include saturated aliphatic diols. Examples of the saturated aliphatic diols include linear saturated aliphatic diols and branched saturated aliphatic diols, with linear saturated aliphatic diols being preferred, with C4-C12 linear saturated aliphatic diols being more preferred. When the branched saturated aliphatic diols are used, the formed crystalline polyester resin decreases in crystallinity and thus decreases in melting point in some cases. Also, in a case when the number of carbon atoms contained in the main chain thereof is less than 4, when such diols are polycondensated with an aromatic dicarboxylic acid, the formed crystalline polyester resin may increase in melting temperature to prevent low temperature fixing. Whereas, such diols that have carbon atoms exceeding 12 in the main chain thereof are difficult to obtain practically.

Examples of the saturated aliphatic diols include ethylene glycol, 1,3-propanediol, 1,4-butanediol, 1,5-pentandiol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. Among them, preferred are 1,4-butanediol, 1,6-hexanediol, 1,8-octanediol, 1,10-decanediol and 1,12-dodecanediol, since the formed crystalline polyester resin has high crystallinity and excellent sharp melt property.

Examples of the trihydric or higher alcohols include glycerin, trimethylolethane, trimethylolpropane and pentaerythritol.

These may be used alone or in combination.

—Polycarboxylic Acid Component—

The polycarboxylic acid component is not particularly limited and may be appropriately selected depending on the intended purpose. Examples thereof include divalent carboxylic acids and tri- or higher valent carboxylic acids.

Examples of the divalent carboxylic acids include saturated aliphatic dicarboxylic acids such as oxalic acid, malonic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids; e.g., phthalic acid, isophthalic acid, terephthalic acid and naphthalene-2,6-dicarboxylic acid; and anhydrides or lower alkyl esters thereof.

Examples of the tri- or higher valent carboxylic acids include 1,2,4-benzenetricarboxylic acid, 1,2,5-benzenetricarboxylic acid and 1,2,4-naphthalenetricarboxylic acid; and anhydrides or lower alkyl esters thereof.

The polycarboxylic acid component may further contain a dicarboxylic acid component having a sulfonic acid group, in addition to the saturated aliphatic dicarboxylic acid and/or the aromatic dicarboxylic acid. Moreover, it may further contain a dicarboxylic acid component having a double bond such as mesaconic acid, in addition to the saturated aliphatic dicarboxylic acid and/or the aromatic dicarboxylic acid.

These may be used alone or in combination.

It is preferred that the crystalline polyester resin have a constituent unit derived from the saturated aliphatic dicarboxylic acid and a constituent unit derived from the saturated aliphatic diol, since it has high crystallinity to be excellent in sharp melt property and hence excellent in low temperature fixability.

The melting point of the crystalline polyester resin is not particularly limited and may be appropriately selected depending on the intended purpose. It is preferably 60° C. or higher but lower than 80° C. When the melting point thereof is lower than 60° C., the crystalline polyester resin easily melts at low temperatures, potentially degrading the toner in heat resistance storage stability. Whereas when it is 80° C. or higher, the crystalline polyester resin does not sufficiently melt with heating upon fixing of the resin, potentially degrading the toner in low temperature fixability.

The melting point can be measured based on the endothermic peak value in a differential scanning calorimetry (DSC) chart obtained through measurement with a differential scanning calorimeter (DSC).

The molecular weight of the crystalline polyester resin is not particularly limited and may be appropriately selected depending on the intended purpose. The crystalline polyester resin having a sharp molecular weight distribution and a low molecular weight is excellent in low temperature fixability. Also, when there is a large amount of low-molecular-weight components, the crystalline polyester resin is degraded in heat resistance storage stability.

From this viewpoint, through GPC measurement, soluble matter of the crystalline polyester resin in o-dichlorobenzene preferably has a weight average molecular weight (Mw) of 3,000 to 30,000, a number average molecular weight (Mn) of 1,000 to 10,000, and a Mw/Mn of 1.0 to 10.

More preferably, the weight average molecular weight (Mw) thereof is 5,000 to 15,000, the number average molecular weight (Mn) thereof is 2,000 to 10,000, and the Mw/Mn thereof is 1.0 to 5.0.

The acid value of the crystalline polyester resin is not particularly limited and may be appropriately selected depending on the intended purpose. In order to achieve desired low temperature fixability from the viewpoint of affinity between paper and resin, it is preferably 5 mgKOH/g or higher, more preferably 10 mgKOH/g or higher. In order to improve hot offset resistance, it is preferably 45 mgKOH/g or lower.

The hydroxyl value of the crystalline polyester resin is not particularly limited and may be appropriately selected depending on the intended purpose. In order to achieve desired low temperature fixability and good charging properties, it is preferably 0 mgKOH/g to 50 mgKOH/g, more preferably 5 mgKOH/g to 50 mgKOH/g.

The molecular structure of the crystalline polyester resin can be confirmed, for example, by NMR measurement of the crystalline polyester resin in a solution or as a solid, as well as by measurement of the crystalline polyester resin using X-ray diffraction, GC/MS, LC/MS, IR, etc. In the infrared absorption spectrum, the crystalline polyester resin may be detected on the basis of absorption at wavelengths of 965 $cm^{-1}$±10 $cm^{-1}$ and 990 $cm^{-1}$±10 $cm^{-1}$, which is based on an out-of-plane bending vibration (δCH) of an olefin.

The amount of the crystalline polyester resin is not particularly limited and may be appropriately selected depending on the intended purpose. It is preferably 2% by mass to 20% by mass, more preferably 5% by mass to 15% by mass, relative to the amount of the toner. When it is less than 2% by mass, the crystalline polyester resin cannot sufficiently exhibit its sharp melt property to potentially degrade the toner in low temperature fixability. When it is more than 20% by mass, the formed toner may be degraded in heat resistance storage stability and may easily cause image fogging. When the amount of the crystalline polyester resin falls within the above more preferred range, the formed toner advantageously is excellent in all of image quality, stability and low temperature fixability.

<Crystal Nucleating Agent>

In the present invention, the crystal nucleating agent is used for promoting recrystallization of the crystalline polyester resin.

Use of the crystal nucleating agent can prevent the non-crystalline polyester resin and the crystalline polyester resin from being in a compatible state in the toner production process, making it possible for the toner to be improved in heat resistance storage stability.

In commonly used toners, the crystalline polyester resin and the non-crystalline polyester resin are in a compatible state with heating upon fixing. Thus, the fixed image has the non-crystalline polyester resin plasticized with the crystalline polyester resin. As a result, the fixed toner image (printed matter) formed using the toner containing the crystalline polyester resin degrades in blocking resistance.

In the present invention, the crystal nucleating agent promotes recrystallization of the crystalline polyester resin after fixing, achieving excellent low temperature fixability and desired blocking resistance of the fixed toner image.

When mixed with the crystalline polyester resin, the crystal nucleating agent has an effect of making the exothermic peak temperature attributed to the crystalline polyester resin in the resultant mixture higher than the exothermic peak temperature observed for the crystalline polyester resin alone. Notably, "exothermic peak temperature" refers to an exothermic peak temperature measured through differential scanning calorimetry (DSC). Unless otherwise specified, the same applies hereinafter.

The crystal nucleating agent has a higher exothermic peak temperature than that of the crystalline polyester resin. Thus, it crystallizes in the toner at a higher temperature than in the crystalline polyester resin, promoting recrystallization of the crystalline polyester resin. As a result, the crystalline polyester resin melted with heating during toner production and image forming process tends to be recrystallized. Thus, the formed toner is increased in heat resistance storage stability and blocking resistance of the toner image after fixing.

In the toner of the present invention, the exothermic peak temperature Tc [° C.] of the crystal nucleating agent is higher than the exothermic peak temperature Tp [° C.] of the crystalline polyester resin by more than 10° C. That is, they satisfy the following expression (I).

$$Tc > Tp + 10 \qquad \text{Expression (I)}$$

where Tp denotes the lowest exothermic peak temperature in a range of 0° C. to 200° C. in a differential scanning calorimetry (DSC) curve obtained through DSC of the crystalline polyester resin; and Tc denotes the lowest exothermic peak temperature in a range of 0° C. to 200° C. in a differential scanning calorimetry (DSC) curve obtained through DSC of the crystal nucleating agent.

When the crystal nucleating agent and the crystalline polyester resin do not satisfy the above expression (I); i.e., $Tc \leq Tp+10$, crystallization of the crystal nucleating agent occurs only at low temperatures. Thus, the crystallization of the crystalline polyester resin is not sufficiently promoted, and the formed toner is degraded in heat resistance storage stability and blocking resistance of the toner image after fixing.

In the present invention, the exothermic peak temperature Tm [° C.] of the mixture of the crystal nucleating agent and the crystalline polyester resin is higher than the exothermic peak temperature Tp [° C.] of the crystalline polyester resin by more than 2° C. That is, they satisfy the following expression (II).

$$Tm > Tp + 2 \qquad \text{Expression (II)}$$

where Tm denotes the lowest exothermic peak temperature in a range of 0° C. to 200° C. in a differential scanning calorimetry (DSC) curve obtained through DSC of the mixture of the crystalline polyester resin and the crystal nucleating agent. The mixture of the crystalline polyester resin and the crystal nucleating agent can be obtained as follows. Specifically, 10 parts by mass of the crystal nucleating agent and 90 parts by mass of the crystalline polyester resin are heated and melted at 200° C., followed by stirring for 1 hour. Then, the resultant mixture is cooled at 25° C. for 2 hours.

When the mixture of the crystal nucleating agent and the crystalline polyester resin does not satisfy the above expression (II); i.e., $Tm \leq Tp+2$, the crystal nucleating agent does not exhibit a sufficient effect of crystallizing the crystalline polyester resin. Thus, the formed toner is degraded in heat resistance storage stability and blocking resistance of the toner image after fixing. When the mixture of the crystal nucleating agent and the crystalline polyester resin satisfies the above expression (II), the crystal nucleating agent is not in the compatible state with the non-crystalline polyester resin. Thus, the crystal nucleating agent can exhibit its crystallization promoting effect of the crystalline polyester resin, and the formed toner is excellent in heat resistance storage stability and blocking resistance of the toner image after fixing.

The mixture of the crystal nucleating agent and the crystalline polyester resin preferably satisfies the following expression (II'): $Tm > Tp+5$. By doing so, the formed toner can be improved in heat resistance storage stability and blocking resistance of the toner image after fixing.

Examples of the crystal nucleating agent include aliphatic amide compounds and aliphatic ester compounds. Among them, aliphatic amide compounds are preferred, since they have affinity for the crystalline polyester resin but are somewhat different in structure from it to have appropriately low compatibility with the crystalline polyester resin, to easily form nuclei of crystals, and to highly improve crystallinity.

The melting point of the crystal nucleating agent is preferably 70° C. or higher but lower than 120° C.

—Aliphatic Amide Compound—

When an aliphatic amide compound is used as the crystal nucleating agent in the present invention, the melting point of the aliphatic amide compound is 60° C. or higher but lower than 150° C. Examples of the aliphatic amide compound include monoamide compounds, monoalcohol-added amide compounds, bisalcohol-added amide compounds and bisamide compounds.

—Monoamide Compound—

The monoamide compound is represented by the following General Formula (1-1) or General Formula (1-2).

$$R_1\text{—}CONH_2 \qquad \text{General Formula (1-1)}$$

In General Formula (1-1), $R_1$ represents a saturated or monounsaturated or diunsaturated hydrocarbon group having 10 to 30 carbon atoms.

$$R_1\text{—}CONH\text{—}R_2 \qquad \text{General Formula (1-2)}$$

In General Formula (1-2), $R_1$ and $R_2$ each independently represent a saturated or monounsaturated or diunsaturated hydrocarbon group having 10 to 30 carbon atoms.

—Monoalcohol-Added Amide Compound—

The monoalcohol-added amide compound is represented by the following General Formula (2).

$$R_1\text{—}NHCO\text{—}R_2\text{—}OH \qquad \text{General Formula (2)}$$

In General Formula (2), $R_1$ represents a saturated or monounsaturated or diunsaturated hydrocarbon group having 10 to 30 carbon atoms and $R_2$ represents a saturated or monounsaturated or diunsaturated hydrocarbon group having 1 to 30 carbon atoms.

—Bisalcohol-Added Amide Compound—

The bisalcohol-added amide compound is represented by the following General Formula (3).

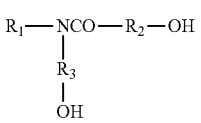

General Formula (3)

In General Formula (3), $R_1$ represents a saturated or monounsaturated or diunsaturated hydrocarbon group having 10 to 30 carbon atoms, $R_2$ represents a saturated or monounsaturated or diunsaturated hydrocarbon group having 1 to 30 carbon atoms, and $R_3$ represents a saturated or monounsaturated or diunsaturated hydrocarbon group having 1 to 30 carbon atoms.

—Bisamide Compound—

The bisamide is represented by the following General Formula (4).

$$R_1—CONH—R_2—HNCO—R_3 \quad \text{General Formula (4)}$$

In General Formula (4), $R_1$, $R_2$ and $R_3$ each independently represent a saturated or monounsaturated or diunsaturated hydrocarbon group having 10 to 30 carbon atoms.

The melting point of the aliphatic amide compound is 60° C. or higher but lower than 150° C. as described above. It is preferably 70° C. or higher but lower than 120° C., more preferably 70° C. or higher but lower than 90° C. When it is lower than 60° C., the formed toner may be degraded in heat resistance storage stability. When it is 150° C. or higher, the formed toner cannot exhibit satisfactory low temperature fixability in some cases.

The aliphatic amide compound having a melting point of 60° C. or higher but lower than 150° C. is not particularly limited and may be appropriately selected depending on the intended purpose. Examples thereof include monoamide compounds such as palmitic amide, palmitoleic amide, stearic amide, oleic amide, arachidic amide, eicosenoic amide, behenic amide, erucic amide and lignoceric amide each of which is produced from a C10 to C30 saturated or monounsaturated fatty acid through amidation; and fatty acid amide alcohol adducts such as palmitic acid monoethanol amide, stearic acid monoethanol amide, behenic acid monoethanol amide, lignoceric acid monoethanol amide, erucic acid monoethanol amide, palmitic acid monopropanol amide, stearic acid monopropanol amide, behenic acid monopropanol amide, lignoceric acid monopropanol amide, erucic acid monopropanol amide, palmitic acid bisethanol amide, stearic acid bisethanol amide, behenic acid bisethanol amide, lignoceric acid bisethanol amide, erucic acid bisethanol amide, palmitic acid bispropanol amide, stearic acid bispropanol amide, behenic acid bispropanol amide, lignoceric acid bispropanol amide, erucic acid bispropanol amide, ethanolamine distearate, ethanolamine dibehenate, ethanolamine dilignocerate, ethanolamine dierucate, propanolamine distearate, propanolamine dibehenate, propanolamine dilignocerate and propanolamine dierucate.

—Aliphatic Ester Compound—

The crystal nucleating agent in the present invention may be an aliphatic ester compound produced through esterification between a fatty acid and an aliphatic alcohol. The melting point of the aliphatic ester is preferably 60° C. or higher but lower than 150° C., preferably 70° C. or higher but lower than 120° C., more preferably 70° C. or higher but lower than 90° C.

Examples of the aliphatic alcohol include monohydric aliphatic alcohols such as lauryl alcohol, palmityl alcohol, stearyl alcohol and behenyl alcohol; and dihydric aliphatic alcohols such as ethylene glycol, propylene glycol, butylene glycol, tetramethylene glycol, butandiol, pentanediol, hexanediol, heptanediol, nonanediol, decanediol and dodecanediol.

The number of carbon atoms in the aliphatic alcohol is not particularly limited and may be appropriately selected depending on the intended purpose. It is preferably 10 to 30.

Examples of the fatty acid include monovalent carboxylic acids such as lauric acid, palmitic acid, arachidic acid, eicosanoic acid, lignoceric acid, stearic acid and behenic acid; and divalent aliphatic carboxylic acids such as fumaric acid, adipic acid, octanedioic acid, sebacic acid and dodecanedioic acid.

The number of carbon atoms of the fatty acid is not particularly limited and may be appropriately selected depending on the intended purpose. It is preferably 10 to 30.

The amount of the crystal nucleating agent is not particularly limited and may be appropriately selected depending on the intended purpose. It is preferably 0.1% by mass to 5.0% by mass, more preferably 0.3% by mass to 3.0% by mass, particularly preferably 0.5% by mass to 2.0% by mass, relative to the amount of the toner.

<Releasing Agent>

The releasing agent is not particularly limited and may be appropriately selected from known releasing agents.

Examples of waxes usable as the releasing agent include natural waxes such as vegetable waxes (e.g., carnauba wax, cotton wax, Japan wax and rice wax); animal waxes (e.g., bees wax and lanolin); mineral waxes (e.g., ozokelite and ceresine) and petroleum waxes (e.g., paraffin waxes, microcrystalline waxes and petrolatum).

Examples of waxes other than the above natural waxes include synthetic hydrocarbon waxes (e.g., Fischer-Tropsch waxes, polyethylene and polypropylene); and synthetic waxes (e.g., esters, ketones and ethers).

Further examples include low-molecular-weight crystalline polymers such as polyacrylate homopolymers (e.g., poly-n-stearyl methacrylate and poly-n-lauryl methacrylate) and polyacrylate copolymers (e.g., n-stearyl acrylate-ethyl methacrylate copolymers); and crystalline polymers having a long alkyl group in the side chain thereof.

Among them, preferred are hydrocarbon waxes such as paraffin waxes, microcrystalline waxes, Fischer-Tropsch waxes, polyethylene waxes and polypropylene waxes.

The melting point of the releasing agent is not particularly limited and may be appropriately selected depending on the intended purpose, but is preferably 60° C. or higher but lower than 95° C.

The releasing agent is more preferably a hydrocarbon wax having a melting point of 60° C. or higher but lower than 95° C. Such releasing agent can effectively act as the releasing agent on the interface between the fixing roller and the toner. Thus, even when the releasing agent such as oil is not applied to the fixing roller, the hot offset resistance of the toner can be improved.

In particular, the hydrocarbon wax is substantially not in the compatible state with the crystalline polyester resin, and thus they can function independently of each other. The hydrocarbon wax is preferred since it does not impair the softening effect of the crystalline polyester resin serving as the binder resin and the offset resistance of the releasing agent.

When the melting point of the releasing agent is lower than 60° C., the releasing agent easily melts at low temperatures and thus the formed toner may be degraded in heat resistant storage stability. Whereas when the melting point of the releasing agent is 95° C. or higher, the releasing agent insufficiently melts with heating upon fixing and thus the toner cannot exhibit satisfactory offset resistance in some cases.

The amount of the releasing agent is not particularly limited and may be appropriately selected depending on the intended purpose. The amount of the releasing agent contained in the toner is preferably 2% by mass to 10% by mass, more preferably 3% by mass to 8% by mass. When it is less than 2% by mass, the formed toner may be degraded in low temperature fixability and hot offset resistance upon fixing. Whereas when it is more than 10% by mass, the formed toner may be degraded in heat resistant storage stability and may cause fogging of images. When the amount of the releasing agent contained in the toner falls within the above more preferred range, the formed toner is advantageously improved in high-quality image formation and fixing stability.

<Colorant>

The colorant is not particularly limited and may be appropriately selected depending on the intended purpose. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone.

The amount of the colorant is not particularly limited and may be appropriately selected depending on the intended purpose. It is preferably 1% by mass to 15% by mass, more preferably 3% by mass to 10% by mass, relative to the toner.

The colorant may be directly used together with other toner materials, or may be mixed with a resin to form a masterbatch. Examples of the resin which is used for producing a masterbatch or which is kneaded together with a masterbatch include the above-described non-crystalline polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required). In this mixing/kneading, a high-shearing disperser (e.g., three-roll mill) is preferably used.

<Other Ingredients>

The other ingredients are not particularly limited and may be appropriately selected depending on the intended purpose. Examples thereof include polymers each containing a site reactive with an active hydrogen group-containing compound, active hydrogen group-containing compounds, charge controlling agents, external additives, flowability improving agents, cleanability improving agents and magnetic materials.

—Polymer Containing a Site Reactive with an Active Hydrogen Group-Containing Compound (Prepolymer)—

The polymer containing a site reactive with an active hydrogen group-containing compound (hereinafter may be referred to as "prepolymer") is not particularly limited and may be appropriately selected depending on the intended purpose. Examples thereof include polyol resins, polyacryl resins, polyester resins, epoxy resins and derivatives thereof. These may be used alone or in combination.

Among them, preferred are polyester resins from the viewpoint of exhibiting high flowability upon melting and high transparency.

In the prepolymer, examples of the site reactive with the active hydrogen group-containing compound include an isocyanate group, an epoxy group, a carboxyl group, and a functional group expressed by —COCl. These may be used alone or in combination.

Among them, an isocyanate group is preferred.

The prepolymer is not particularly limited and may be appropriately selected depending on the intended purpose. It is preferably a polyester resin containing, for example, an isocyanate group able to form a urethane bond since it is easily controlled in molecular weight. In addition, the polyester resin makes it possible for a dry toner to have oil-less low-temperature fixability. Furthermore, even when there is no releasing oil-application mechanism for a heating medium for fixing, use of the polyester resin ensures good releaseability and fixability.

—Active Hydrogen Group-Containing Compound—

The active hydrogen group-containing compound acts, in an aqueous medium, as an elongation agent or crosslinking agent at the time of elongation reaction or crosslinking reaction of the polymer containing a site reactive with the active hydrogen group-containing compound.

The active hydrogen group is not particularly limited and may be appropriately selected depending on the intended purpose. Examples thereof include hydroxyl groups such as an alcoholic hydroxyl group and phenolic hydroxyl group, amino group, carboxyl group and mercapto group. These may be used alone or in combination.

The active hydrogen group-containing compound is not particularly limited and may be appropriately selected depending on the intended purpose. In cases where the polyester resin containing a functional group reactive with the active hydrogen group-containing compound is an isocyanate group-containing polyester prepolymer, amines are preferable from the viewpoint of ability to increase molecular weight by the elongation reaction or crosslinking reaction with the isocyanate group-containing polyester prepolymer.

The amines are not particularly limited and may be appropriately selected depending on the intended purpose. Examples thereof include diamines, trivalent or higher amines, amino alcohols, amino mercaptans, amino acids, and compounds obtained by blocking the amino groups thereof. These may be used alone or in combination.

Among them, preference is given to the diamines, and mixtures containing any of the diamines and a small amount of any of the trivalent or higher amines.

The diamines are not particularly limited and may be appropriately selected depending on the intended purpose. Examples thereof include aromatic diamines, alicyclic diamines and aliphatic diamines. The aromatic diamines are not particularly limited and may be appropriately selected depending on the intended purpose. Examples of the aromatic diamines include phenylenediamine, diethyltoluenediamine and 4,4'-diaminodiphenylmethane. The alicyclic diamines are not particularly limited and may be appropriately selected depending on the intended purpose. Examples of the alicyclic diamines include 4,4'-diamino-3,3'-dimethyldicyclohexylmethane, diaminecyclohexane and isophoronediamine. The aliphatic diamines are not particularly limited and may be appropriately selected depending on the intended purpose. Examples of the aliphatic diamines include ethylenediamine, tetramethylenediamine and hexamethylenediamine.

The trivalent or higher amines are not particularly limited and may be appropriately selected depending on the intended purpose. Examples thereof include diethylenetriamine and triethylenetetramine.

The amino alcohols are not particularly limited and may be appropriately selected depending on the intended purpose. Examples thereof include ethanolamine and hydroxyethylaniline.

The amino mercaptans are not particularly limited and may be appropriately selected depending on the intended purpose. Examples thereof include aminoethyl mercaptan and aminopropyl mercaptan.

The amino acids are not particularly limited and may be appropriately selected depending on the intended purpose. Examples thereof include aminopropionic acid and aminocaproic acid.

The compounds obtained by blocking the amino groups of the above amines are not particularly limited and may be appropriately selected depending on the intended purpose. Examples thereof include oxazoline compounds and ketimine compounds obtained by blocking the amino groups of the amines with ketones such as acetone, methy ethyl ketone and methyl isobutyl ketone.

—Isocyanate Group-Containing Polyester Resin—

The isocyanate group-containing polyester resin (hereinafter may be referred to as "isocyanate group-containing polyester prepolymer") is not particularly limited and may be appropriately selected depending on the intended purpose. Examples thereof include products obtained through reaction between polyisocyanates and active hydrogen group-containing polyester resins which are obtained through polycondensation between polyols and polycarboxylic acids.

—Polyol—

The polyol is not particularly limited and may be appropriately selected depending on the intended purpose. Examples thereof include diols, trihydric or higher alcohols, and mixtures of diols and trihydric or higher alcohols. These may be used alone or in combination.

Among them, the polyol is preferably diols and mixtures of diols and a small amount of trihydric or higher alcohols.

The diol is not particularly limited and may be appropriately selected depending on the intended purpose. Examples thereof include alkylene glycols such as ethylene glycol, 1,2-propylene glycol, 1,3-propylene glycol, 1,4-butanediol and 1,6-hexanediol; oxyalkylene group-containing diols such as diethylene glycol, triethylene glycol, dipropylene glycol, polyethylene glycol, polypropylene glycol and polytetramethylene glycol; alicyclic diols such as 1,4-cyclohexane dimethanol and hydrogenated bisphenol A; adducts of the above-listed alicyclic diols with alkylene oxides such as ethylene oxide, propylene oxide and butylene oxide; bisphenols such as bisphenol A, bisphenol F and bisphenol S; and adducts of the above-listed bisphenols with alkylene oxides such as ethylene oxide, propylene oxide and butylene oxide. The number of carbon atoms contained in each of the above alkylene glycols is not particularly limited and may be appropriately selected depending on the intended purpose, but is preferably 2 to 12.

Among them, preferred are C2-C12 alkylene glycols and adducts of the bisphenols with alkylene oxides, and more preferred are adducts of the bisphenols with alkylene oxides and mixtures containing adducts of the bisphenols with alkylene oxides and C2-C12 alkylene glycols.

The trihydric or higher alcohols are not particularly limited and may be appropriately selected depending on the intended purpose. Examples thereof include trihydric or higher aliphatic alcohols, trihydric or higher polyphenols, and alkylene oxide adducts of trihydric or higher polyphenols.

The trihydric or higher aliphatic alcohols are not particularly limited and may be appropriately selected depending on the intended purpose. Examples thereof include glycerin, trimethylolethane, trimethylolpropane, pentaerythritol and sorbitol.

The trihydric or higher polyphenols are not particularly limited and may be appropriately selected depending on the intended purpose. Examples thereof include trisphenol A, phenol novolak and cresol novolak.

The alkylene oxide adducts of trihydric or higher polyphenols are not particularly limited and may be appropriately selected depending on the intended purpose. Examples thereof include adducts of trihydric or higher polyphenols with alkylene oxides such as ethylene oxide, propylene oxide and butylene oxide.

When using the diol and the trihydric or higher alcohol in combination, the ratio by mass of the trihydric or higher alcohol to the diol is not particularly limited and may be appropriately selected depending on the intended purpose. The amount of the trihydric or higher alcohol relative to the amount of the diol is preferably 0.01% by mass to 10% by mass, more preferably 0.01% by mass to 1% by mass.

—Polycarboxylic Acid—

The polycarboxylic acids are not particularly limited and may be appropriately selected depending on the intended purpose. Examples thereof include dicarboxylic acids, tri- or higher valent carboxylic acids, and mixtures containing dicarboxylic acids and tri- or higher valent carboxylic acids. These may be used alone or in combination.

Among them, preferred are dicarboxylic acids and mixtures containing dicarboxylic acids and a small amount of tri- or higher valent polycarboxylic acids.

The dicarboxylic acids are not particularly limited and may be appropriately selected depending on the intended purpose. Examples thereof include divalent alkane acids, divalent alkene acids and aromatic dicarboxylic acids.

The divalent alkane acids are not particularly limited and may be appropriately selected depending on the intended purpose. Examples thereof include succinic acid, adipic acid and sebacic acid.

The divalent alkene acids are not particularly limited and may be appropriately selected depending on the intended purpose, but are preferably C4-C20 divalent alkene acids. The C4-C20 divalent alkene acids are not particularly limited and may be appropriately selected depending on the intended purpose. Examples thereof include maleic acid and fumaric acid.

The aromatic dicarboxylic acids are not particularly limited and may be appropriately selected depending on the intended purpose, but are preferably C8-C20 aromatic dicarboxylic acids. The C8-C20 aromatic dicarboxylic acids are not particularly limited and may be appropriately selected depending on the intended purpose. Examples thereof include phthalic acid, isophthalic acid, terephthalic acid and naphthalene dicarboxylic acid.

The tri- or higher valent carboxylic acids are not particularly limited and may be appropriately selected depending on the intended purpose. Examples thereof include tri- or higher valent aromatic carboxylic acids.

The tri- or higher valent aromatic carboxylic acids are not particularly limited and may be appropriately selected depending on the intended purpose, but are preferably C9-C20 tri- or higher valent aromatic carboxylic acids. The C9-C20 tri- or higher valent aromatic carboxylic acids are not particularly limited and may be appropriately selected depending on the intended purpose. Examples thereof include trimellitic acid and pyromellitic acid.

There may also be used anhydrides or lower alkyl esters of the dicarboxylic acids, tri- or higher valent polycarboxylic acids, and mixtures containing dicarboxylic acids and tri- or higher valent polycarboxylic acids.

The lower alkyl ester is not particularly limited and may be appropriately selected depending on the intended purpose. Examples thereof include methyl ester, ethyl ester and isopropyl ester.

When using the dicarboxylic acid and the tri- or higher valent carboxylic acid in combination, the ratio by mass of the tri- or higher valent carboxylic acid to the dicarboxylic acid is not particularly limited and may be appropriately selected depending on the intended purpose. The amount of the tri- or higher valent carboxylic acid relative to the amount of the dicarboxylic acid is preferably 0.01% by mass to 10% by mass, more preferably 0.01% by mass to 1% by mass.

In the polycondensation between the polyol and the polycarboxylic acid, the equivalent ratio of the hydroxyl group of the polyol to the carboxyl group of the polycarboxylic acid is not particularly limited and may be appropriately selected depending on the intended purpose. It is preferably 1 to 2, more preferably 1 to 1.5, particularly preferably 1.02 to 1.3.

The amount of the polyol-derived constituent units contained in the isocyanate group-containing polyester prepolymer is not particularly limited and may be appropriately selected depending on the intended purpose. It is preferably 0.5% by mass to 40% by mass, more preferably 1% by mass to 30% by mass, particularly preferably 2% by mass to 20% by mass.

When it is less than 0.5% by mass, there is a decrease in hot offset resistance, potentially making it difficult for the formed toner to have both desired heat resistance storage stability and desired low temperature fixability. Whereas when it is more than 40% by mass, there may be a decrease in low temperature fixability.

—Polyisocyanate—

The polyisocyanate is not particularly limited and may be appropriately selected depending on the intended purpose. Examples thereof include aliphatic diisocyanates, alicyclic diisocyanates, aromatic diisocyanates, aromatic aliphatic diisocyanate, isocyanurates, and products obtained by blocking them with, for example, phenol derivatives, oxime and caprolactam.

The aliphatic diisocyanate is not particularly limited and may be appropriately selected depending on the intended purpose. Examples thereof include tetramethylene diisocyanate, hexamethylene diisocyanate, 2,6-diisocyanatomethylcaproate, octamethylene diisocyanate, decamethylene diisocyanate, dodecamethylene diisocyanate, tetradecamethylene diisocyanate, trimethylhexane diisocyanate and tetramethylhexane diisocyanate.

The alicyclic diisocyanate is not particularly limited and may be appropriately selected depending on the intended purpose. Examples thereof include isophoron diisocyanate and cyclohexylmethane diisocyanate.

The aromatic diisocyanate is not particularly limited and may be appropriately selected depending on the intended purpose. Examples thereof include tolylene diisocyanate, diisocyanato diphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane and 4,4'-diisocyanato-diphenylether.

The aromatic aliphatic diisocyanate is not particularly limited and may be appropriately selected depending on the intended purpose. Examples thereof include $\alpha,\alpha,\alpha',\alpha'$-tetramethylxylylene diisocyanate.

The isocyanurate is not particularly limited and may be appropriately selected depending on the intended purpose. Examples thereof include tris(isocyanatoalkyl)isocyanurate and tris(isocyanatoalkyl)isocyanurate. These may be used alone or in combination.

In the reaction between the polyisocyanate and the polyester resin having a hydroxyl group, the equivalent ratio of the isocyanate group of the polyisocyanate to the hydroxyl group of the polyester resin is not particularly limited and may be appropriately selected depending on the intended purpose. It is preferably 1 to 5, more preferably 1.2 to 4, particularly preferably 1.5 to 3. When it is less than 1, there may be a decrease in offset resistance. Whereas it is more than 5, there may be a decrease in low temperature fixability.

The amount of the polyisocyanate-derived constituent units contained in the polyisocyanate group-containing polyester prepolymer is not particularly limited and may be appropriately selected depending on the intended purpose, but is preferably 0.5% by mass to 40% by mass, more preferably 1% by mass to 30% by mass, particularly preferably 2% by mass to 20% by mass. When it is less than 0.5% by mass, there may be a decrease in hot offset resistance. Whereas it is more than 40% by mass, there may be a decrease in low temperature fixability.

The average number of the isocyanate groups contained in one molecule of the isocyanate group-containing polyester prepolymer is not particularly limited and may be appropriately selected depending on the intended purpose. It is preferably 1 or more, more preferably 1.2 to 5, particularly preferably 1.5 to 4. When the average number thereof is less than 1, the formed urea-modified polyester resin is decreased in molecular weight, resulting in that the formed toner may be degraded in hot offset resistance.

The ratio by mass of the isocyanate group-containing polyester prepolymer to the total mass of the toner is not particularly limited and may be appropriately selected depending on the intended purpose, but is preferably 5/95 to 25/75, more preferably 10/90 to 25/75. When it is less than 5/95, there may be a decrease in hot offset resistance. Whereas when it is more than 25/75, there may be a decrease in low temperature fixabilitly and/or image glossiness.

—Charge Controlling Agent—

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD); quaternary ammonium salt molybdenum complex TP-302 and TP-415 (these products are of Hodogaya Chemical Co., Ltd.); LRA-901 and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The amount of the charge controlling agent is not particularly limited and may be appropriately selected depending on the intended purpose. It is preferably 0.1% by mass to 10% by mass, more preferably 0.2% by mass to 5% by mass, relative to the amount of the toner. When it is more than 10% by mass, the formed toner has too high chargeability, resulting in that the charge controlling agent exhibits reduced effects. As a result, the electrostatic force increases between the developing roller and the toner, decreasing the flowability of the toner and forming an image with reduced color density. These charge controlling agent and release agent may be melt-kneaded together with a masterbatch or resin, and then dissolved or dispersed. Needless to say, they may be added to an organic solvent simultaneously with the masterbatch or binder resin, or may be fixed on the surfaces of the formed toner particles.

External Additive

Examples of the external additive include fine oxide particles, fine inorganic particles and hydrophobized fine inorganic particles, which can be used alone or in combination. The average particle diameter of the primary particles of the hydrophobized fine inorganic particles is preferably 1 nm to 100 nm, more preferably 5 nm to 70 nm.

Also, the external additive preferably contains at least one type of the hydrophobized fine inorganic particles whose primary particles have an average particle diameter of 20 nm or less and at least one type of the fine inorganic particles whose primary particles have an average particle diameter of 30 nm or more.

In addition, the external additive or fine inorganic particles preferably have a specific surface area of 20 $m^2/g$ to 500 $m^2/g$ as measured by the BET method.

The external additive is not particularly limited and may be appropriately selected depending on the intended purpose. Examples thereof include fine silica particles, hydrophobic silica, fatty acid metal salts (e.g., zinc stearate and aluminum starate), metal oxides (e.g., titania, alumina, tin oxide and antimony oxide) and fluoropolymers.

Suitable additives include hydrophobized particles of fine particles of silica, titania, titanium oxide and alumina.

Examples of the fine silica particles include R972, R974, RX200, RY200, R202, R805 and R812 (these products are of AEROSIL Japan).

Examples of the fine titania particles include P-25 (product of AEROSIL Japan), STT-30, STT-65C-S (these products are of Titan Kogyo, Ltd.), TAF-140 (product of Fuji Titanium Industry Co., Ltd.), MT-150W, MT-500B, MT-600B and MT-150A (these products are of TAYCA Corporation).

Examples of the hydrophobized fine titanium oxide particles include T-805 (product of AEROSIL Japan), STT-30A, STT-65S-S (these products are of Titan Kogyo, Ltd.), TAF-500T, TAF-1500T (these products are of Fuji Titanium Industry Co., Ltd.), MT-100S, MT-100T (these products are of TAYCA Corporation) and IT-S (product of ISHIHARA SANGYO KAISHA, LTD.).

The hydrophobized fine oxide particles, hydrophobized fine silica particles, hydrophobized fine titania particles or hydrophobized fine alumina particles can be obtained by treating hydrophilic fine particles with a silane coupling agent such as methyltrimethoxysilane, methyltriethoxysilane or octyltrimethoxysilane. In addition, preferred are silicone oil-treated fine oxide particles or fine inorganic particles which are obtained by treating fine inorganic particles with silicone oil, if necessary, through application of heat.

Examples of the silicone oil usable include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, (meth)acryl-modified silicone oil and α-methylstyrene-modified silicone oil.

Examples of the fine inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride, with silica and titanium dioxide being preferred.

The amount of the external additive is not particularly limited and may be appropriately selected depending on the intended purpose. It is preferably 0.1% by mass to 5% by mass, more preferably 0.3% by mass to 3% by mass, relative to toner base particles; i.e., toner particles to which the external additives and the charge controlling agent have not yet been added (hereinafter such toner particles are referred to as "toner base particles").

—Flowability Improving Agent—

The flowability improving agent is not particularly limited and may be appropriately selected depending on the intended purpose, so long as it can improve hydrophobic properties through surface treatment and prevent the degradation of flowability or chargeability under high humidity environment. Examples of the flowability improving agent include silane coupling agents, silylation agents, silane coupling agents having a fluorinated alkyl group, organotitanate coupling agents, aluminum coupling agents, silicone oils, and modified silicone oils. Particularly preferably, the above silica and titanium oxide are subjected, before use, to surface treatment with such a flowability improving agent, and then are used respectively as hydrophobized silica and hydrophobized titanium oxide.

—Cleanability Improving Agent—

The cleanability improving agent is not particularly limited and may be appropriately selected depending on the intended purpose, so long as it is added to the toner for removing the developer remaining after transfer on the photoconductor and primary transfer medium (so-called intermediate transfer belt). Examples of the cleanability improving agent include metal salts of fatty acids such as stearic acid (e.g., zinc stearate and calcium stearate), fine polymer particles formed by soap-free emulsion polymerization, such as fine polymethylmethacrylate particles and fine polystylene particles. The fine polymer particles preferably have a relatively narrow particle size distribution. It is preferable that the volume average particle diameter thereof be 0.01 μm to 1 μm.

—Magnetic Material—

The magnetic material is not particularly limited and may be appropriately selected depending on the intended purpose. Examples thereof include iron powder, magnetite and ferrite. It is preferably white in terms of color tone.

<Acid Value>

The acid value of the toner is not particularly limited and may be appropriately selected depending on the intended purpose. It is preferably 0.5 mgKOH/g to 40 mgKOH/g from the viewpoint of controlling, for example, low temperature fixability (minimum fixing temperature) and the temperature at which hot offset occurs. When the acid value thereof is less than 0.5 mg/gKOH, the base cannot contribute to dispersion stability during production in some cases. In addition, when the prepolymer is used, elongation and/or crosslinking reaction proceeds to an undesired extent, potentially leading to degradation of production stability. In the case where the acid value thereof is more than 40 mg/gKOH, when the prepolymer is used, elongation reaction and/or crosslinking reaction does not sufficiently proceed, potentially leading to degradation of hot offset resistance.

<Glass Transition Temperature (Tg)>

The glass transition temperature (Tg) of the toner is not particularly limited and may be appropriately selected depending on the intended purpose. The toner preferably has a Tg1st of 20° C. or higher but lower than 60° C., more preferably 30° C. to 50° C., where the Tg1st is measured at the first temperature raising of differential scanning calorimetry (DSC). The toner having such a Tg1st increases in low temperature fixability, heat resistant storage stability and durability. The toner having a Tg1st of lower than 20° C. may involve blocking in developing apparatuses and filming on photoconductors. The toner having a Tg1st of 60° C. or higher may decrease in low temperature fixability.

The toner preferably has a Tg2nd of 10° C. or higher but lower than 30° C., where the Tg2nd is measured at the second temperature raising of differential scanning calorimetry (DSC). The toner having a Tg2nd of lower than 10° C. may involve degrading of printed matter in image blocking, blocking in developing apparatuses and filming on photoconductors. The toner having a Tg2nd of 30° C. or higher may decrease in low temperature fixability.

Notably, below will be described in detail the Tg1st; i.e., a glass transition temperature measured at the first temperature raising of differential scanning calorimetry, and the Tg2nd; i.e., a glass transition temperature measured at the second temperature raising of differential scanning calorimetry.

<Volume Average Particle Diameter>

The volume average particle diameter of the toner is not particularly limited and may be appropriately selected depending on the intended purpose, but is preferably 3 μm to 7 μm. Also, the ratio of the volume average particle diameter to the number average particle diameter is preferably 1.2 or lower. Also, the toner preferably contains a component having a volume average particle diameter of 2 μm or less in an amount of 1% by number to 10% by number.

[Measurement Methods for Acid Value and Hydroxyl Value]

The hydroxyl value is measured according to the method of JIS K0070-1966.

Specifically, first, 0.5 g of a sample is accurately weighed in a 100 mL measuring flask, and then 5 mL of an acetylation reagent is added thereto. Next, the measuring flask is heated for 1 hour to 2 hours in a hot water bath set to 100° C.±5° C., and is then taken out from the hot water bath and left to cool. In addition, water is added to the measuring flask, which is then shaken to decompose acetic anhydride. Next, for completely decomposing acetic anhydride, the flask is heated again in the hot water bath for 10 minutes or longer and then left to cool. Thereafter, the wall of the flask is thoroughly washed with an organic solvent.

Then, a potentiometric automatic titrator DL-53 (product of Mettler-Toledo K.K.) and an electrode DG113-SC (product of Mettler-Toledo K.K.) are used to measure the hydroxyl value at 23° C. The measurements are analyzed with analysis software LabX Light Version 1.00.000. The calibration for this apparatus is performed using a solvent mixture of toluene (120 mL) and ethanol (30 mL).

The measurement conditions are as follows.

| [Measurement Conditions] | |
|---|---|
| Stir | |
| Speed[%] | 25 |
| Time[s] | 15 |
| EQP titration Titrant/Sensor | |
| Titrant | CH3ONa |
| Concentration[mol/L] | 0.1 |
| Sensor | DG115 |
| Unit of measurement | mV |
| Predispensing to volume | |
| Volume[mL] | 1.0 |
| Wait time[s] | 0 |
| Titrant addition | Dynamic |
| dE(set)[mV] | 8.0 |
| dV(min)[mL] | 0.03 |
| dV(max)[mL] | 0.5 |

-continued

| [Measurement Conditions] | |
|---|---|
| Measure mode | Equilibrium controlled |
| dE[mV] | 0.5 |
| dt[s] | 1.0 |
| t(min)[s] | 2.0 |
| t(max)[s] | 20.0 |
| Recognition | |
| Threshold | 100.0 |
| Steepest jump only | No |
| Range | No |
| Tendency | None |
| Termination | |
| at maximum volume[mL] | 10.0 |
| at potential | No |
| at slope | No |
| after number EQPs | Yes |
| n = 1 | |
| comb. termination conditions | No |
| Evaluation | |
| Procedure | Standard |
| Potential1 | No |
| Potential2 | No |
| Stop for reevaluation | No |

The acid value is measured according to the method of JIS K0070-1992.

Specifically, first, 0.5 g of a sample (soluble matter in ethyl acetate: 0.3 g) is added to 120 mL of toluene, and the resultant mixture is stirred for about 10 hours at 23° C. for dissolution. Next, ethanol (30 mL) is added thereto to prepare a sample solution. Notably, when the sample is not dissolved in toluene, another solvent such as dioxane or tetrahydrofuran is used. Then, a potentiometric automatic titrator DL-53 (product of Mettler-Toledo K.K.) and an electrode DG113-SC (product of Mettler-Toledo K.K.) are used to measure the acid value at 23° C. The measurements are analyzed with analysis software LabX Light Version 1.00.000. The calibration for this apparatus is performed using a solvent mixture of toluene (120 mL) and ethanol (30 mL).

The measurement conditions are the same as those set for measuring the hydroxyl value.

The acid value can be measured in the above-described manner. Specifically, the sample solution is titrated with a pre-standardized 0.1N potassium hydroxide/alcohol solution and then the acid value is calculated from the titer using the equation: acid value (mgKOH/g)=titer (mL)×N×56.1 (mg/mL)/mass of sample (g), where N is a factor of 0.1N potassium hydroxide/alcohol solution.

<<Measurement Methods of Exothermic Peak Temperature, Melting Point and Glass Transition Temperature (Tg)>>

In the present invention, the exothermic peak temperature, melting point and glass transition temperature (Tg) of the toner and each material can be measured with, for example, a DSC system (a differential scanning calorimeter) ("DSC-60," product of Shimadzu Corporation).

Specifically, the exothermic peak temperature, melting point and glass transition temperature of a measurement sample can be measured following the below-described procedure.

First, about 5.0 mg of a measurement sample is added to an aluminum sample container. The sample container is placed on a holder unit and set in an electric furnace. Next, in a nitrogen atmosphere, the sample container is heated from 0° C. to 200° C. at a temperature increasing rate of 10° C./min. Thereafter, the sample container is cooled from 200° C. to 0° C. at a temperature decreasing rate of 10° C./min, and then heated to 200° C. at a temperature increasing rate of 10° C./min. In this process, the DSC curve of the sample is measured with a differential scanning calorimeter ("DSC-60," product of Shimadzu Corporation).

From the obtained DSC curves, the glass transition temperature can be obtained at each temperature raising with the analysis program of the DSC-60 system. Specifically, the glass transition temperature of the measurement sample at the first temperature raising is determined from the DSC curve of the first temperature raising with "endothermic shoulder temperature" of the analysis program. The glass transition temperature of the measurement sample at the second temperature raising is determined from the DSC curve of the second temperature raising with "endothermic shoulder temperature" of the analysis program.

Similarly, from the obtained DSC curves, the melting point can be obtained at each temperature raising with the analysis program of the DSC-60 system. Specifically, the melting point of the measurement sample at the first temperature raising is determined from the DSC curve of the first temperature raising with "peak temperature analysis program" of the analysis program. The melting point of the measurement sample at the second temperature raising is determined from the DSC curve of the second temperature raising with "peak temperature analysis program" of the analysis program.

Similarly, the exothermic peak temperature of the measurement sample at the first temperature raising is determined from the DSC curve of the first temperature raising with "peak temperature analysis program" of the analysis program.

In the present invention, the glass transition temperature of a toner (i.e., the measurement sample) at the first temperature raising is defined as Tg1st, and that at the second temperature raising is defined as Tg2nd.

Also, in the present invention, the melting point and Tg of each measurement sample at the second temperature raising are respectively defined as the melting point and Tg thereof.

<<Measurement Method of Exothermic Peak Temperature (Tm [° C.]) of a Mixture of Crystalline Polyester and Crystal Nucleating Agent>>

The Tm in the present invention can be measured by the following method.

Specifically, a crystal nucleating agent (10 g) and a crystalline polyester resin (90 g) are mixed and melted with heating at 200° C., followed by stirring 1 hour. After stirring, the resultant mixture is cooled at 25° C. for 2 hours, to thereby obtain a mixture of the crystalline polyester resin and the crystal nucleating agent.

The resultant mixture can be measured through DSC for exothermic peak temperature; i.e., Tm.

<Measurement Method of Particle Size Distribution>

The volume average particle diameter (D4), number average particle diameter (Dn), and the ratio (D4/Dn) of the toner can be measured with, for example, Coulter Counter TA-II or Coulter Multisizer II (these products are of Coulter, Inc.). In the present invention, Coulter Multisizer II was used as a measurement apparatus. The measurement method will next be described.

First, a surfactant (0.1 mL to 5 mL), preferably a polyoxyethylene alkyl ether (a nonionic surfactant), is added as a dispersing agent to an electrolyte solution (100 mL to 150 mL). Here, the electrolyte solution is a 1% by mass aqueous NaCl solution prepared using 1st grade sodium chloride, and examples of employable products thereof include ISOTON-II (product of Coulter, Inc.). Subsequently, a measurement sample (2 mg to 20 mg) is added to the above-obtained electrolyte solution. The resultant electrolyte solution containing the measurement sample suspended therein is dispersed with an ultrasonic wave disperser for 1 min to 3 min. The thus-obtained dispersion liquid is analyzed with the above-described apparatus using an aperture of 100 μm to measure the number or volume of the toner or toner particles. Then, the volume particle size distribution and number particle size distribution are calculated from the obtained values. From these distributions, the volume average particle diameter (D4) and number average particle diameter (Dn) of the toner can be obtained.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

(Evaluation of Solubility of Crystal Nucleating Agent to Organic Solvent)

The solubility of the crystal nucleating agent to the organic solvent is measured by the following method.

First, 10 g of the crystal nucleating agent and 90 g of the organic solvent are stirred for 1 hour at a predetermined evaluation temperature.

Separately, a filter paper No. 4 for KIRIYAMA funnel (product of Kiriyama glass Co.) is set to a KIRIYAMA funnel (product of Kiriyama glass Co.). Using the KIRIYAMA funnel, the above-obtained solution is subjected to aspiration filtration with an aspirator at a predetermined evaluation temperature, to thereby separate the organic solvent from the crystal nucleating agent.

Furthermore, the thus-separated organic solvent is heated for 1 hour at a temperature higher by 50° C. than the boiling point of the organic solvent, to thereby evaporate the organic solvent. The amount of the crystal nucleating agent soluble (dissolved) in the organic solvent is calculated on the basis of a change in mass before and after heating.

In the present invention, the solubility at 70° C. of the crystal nucleating agent to the organic solvent is preferably 5% by mass or more. When it is less than 5% by mass, it is difficult to finely disperse the crystal nucleating agent in the organic solvent during the toner production step, resulting in that the crystal nucleating agent cannot exhibit its crystallization promoting effect of the crystalline polyester resin in some cases.

Also, the solubility at 25° C. of the crystal nucleating agent to the organic solvent is preferably 0.5% by mass or less. When it is more than 0.5% by mass, it is difficult for the crystal nucleating agent to crystallize in the organic solvent, resulting in the crystal nucleating agent cannot exhibit its crystallization promoting effect of the crystalline polyester resin in some cases.

<Method for Producing Toner>

The toner is preferably granulated through a process including: dispersing, in an aqueous medium, an oil phase containing in an organic solvent at least the non-crystalline polyester resin (binder resin component), the crystalline polyester resin (binder resin component), the crystal nucleating agent, the releasing agent and the colorant (hereinafter these may be referred to as "toner materials"), to thereby form a dispersion liquid; and removing the organic solvent from the dispersion liquid.

Preferably, the organic solvent further contains the active hydrogen group-containing compound and the polymer having a site reactive with the active hydrogen group-containing compound.

One exemplary method of such toner production method is a known dissolution suspension method.

Another exemplary method of such toner production method is the below-described method including forming toner base particles while forming a product through elongating reaction and/or crosslinking reaction between the active hydrogen group-containing compound and the polymer having a site reactive with the active hydrogen group-containing compound (hereinafter this product may be referred to as "adhesive base"). This method includes preparing the aqueous medium, preparing the oil phase containing the toner materials, emulsifying or dispersing the toner materials, and removing the organic solvent.

—Preparation of Aqueous Medium (Aqueous Phase)—

The preparation of the aqueous medium can be performed by, for example, dispersing commonly-used conventional fine resin particles in the aqueous medium. The amount of the fine resin particles added in the aqueous medium is not particularly limited and may be appropriately selected depending on the intended purpose. It is preferably 0.5% by mass to 10% by mass.

The aqueous medium is not particularly limited and may be appropriately selected depending on the intended purpose. Examples thereof include water, water-miscible solvents, and mixtures thereof. These may be used alone or in combination.

Among them, water is preferred.

The water-miscible solvent is not particularly limited and may be appropriately selected depending on the intended purpose. Examples thereof include alcohol, dimethylformamide, tetrahydrofuran, cellosolves and lower ketones. The alcohol is not particularly limited and may be appropriately selected depending on the intended purpose. Examples of the alcohol include methanol, isopropanol and ethylene glycol. The lower ketone is not particularly limited and may be appropriately selected depending on the intended purpose. Examples thereof include acetone and methyl ethyl ketone.

—Preparation of Oil Phase—

The preparation of the oil phase containing the toner materials can be performed by dissolving or dispersing, in the organic solvent, the toner materials containing, for example, the active hydrogen group-containing compound (a precursor of the binder resin component), the polymer having a site reactive with the active hydrogen group-containing compound (a precursor of the binder resin component), the crystalline polyester resin, the non-crystalline polyester resin, the releasing agent and the colorant.

The organic solvent is not particularly limited and may be appropriately selected depending on the intended purpose. It is preferably an organic solvent having a boiling point of lower than 150° C. since such an organic solvent can easily be removed.

The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These solvents may be used alone or in combination.

Among them, preferred are ethyl acetate, toluene, xylene, benzene, methylene chloride, 1,2-dichloroethane, chloroform and carbon tetrachloride and more preferred is ethyl acetate.

—Emulsification or Dispersion—

The emulsifying or dispersing the toner materials can be performed by dispersing, in the aqueous medium, the oil phase containing the toner materials.

In the emulsifying or dispersing the toner materials, the active hydrogen group-containing compound and the polymer having a site reactive with the active hydrogen group-containing compound are allowed to undergo elongating reaction and/or crosslinking reaction, whereby the adhesive base is formed.

Preferably, the adhesive base is formed by, for example, a method including emulsifying or dispersing, in the aqueous medium, the oil phase containing the polymer reactive with the active hydrogen group (e.g., isocyanate group-containing polyester prepolymer) and the active hydrogen group-containing compound (e.g., amines), and allowing, in the aqueous medium, the polyester resin reactive with the active hydrogen group and the active hydrogen group-containing compound to undergo elongating reaction and/or crosslinking reaction. Besides, the adhesive base may be formed by a method including emulsifying or dispersing the oil phase containing the toner materials in the aqueous medium to which the active hydrogen group-containing compound has been added in advance, and allowing, in the aqueous medium, the polyester resin reactive with the active hydrogen group and the active hydrogen group-containing compound to undergo elongating reaction and/or crosslinking reaction; or a method including emulsifying or dispersing the oil phase containing the toner materials in the aqueous medium, adding the active hydrogen group-containing compound to the resultant mixture, and allowing, in the aqueous medium, the polyester resin reactive with the active hydrogen group and the active hydrogen group-containing compound to undergo elongating reaction and/or crosslinking reaction from the interfaces of the particles.

Notably, in the case where the polyester resin reactive with the active hydrogen group and the active hydrogen group-containing compound are allowed to undergo elongating reaction and/or crosslinking reaction from the interfaces of the particles, a urea-modified polyester resin is formed preferentially in the surfaces of the formed toner and as a result, a concentration gradient of the urea-modified polyester resin can be provided in each toner particle.

The reaction conditions for forming the adhesive base (reaction time, reaction temperature) are not particularly limited and may be appropriately selected depending on the combination of the active hydrogen group-containing compound and the polymer having a site reactive with the active hydrogen group-containing compound.

The reaction time is not particularly limited and may be appropriately selected depending on the intended purpose. It is preferably 10 min to 40 hours, more preferably 2 hours to 24 hours.

The reaction temperature is not particularly limited and may be appropriately selected depending on the intended purpose. It is preferably 0° C. to 150° C., more preferably 40° C. to 98° C.

A method for stably dispersing, in the aqueous medium, the polymer having a site reactive with the active hydrogen group-containing compound such as the isocyanate group-containing polyester prepolymer is not particularly limited and may be appropriately selected depending on the intended purpose. Examples of the method include a method in which the oil phase containing the toner materials dissolved or dispersed in the organic solvent is added to the aqueous medium where they are dispersed through application of shearing force.

The dispersion apparatus used for the dispersing is not particularly limited and may be appropriately selected depending on the intended purpose. Examples thereof include low-speed shearing dispersion apparatus, high-speed shearing dispersion apparatus, friction dispersion apparatus, high-pressure jetting dispersion apparatus and ultrasonic wave dispersion apparatus.

In order for the dispersoids (oil droplets) to have a particle diameter of 2 μm to 20 μm, a high-speed shearing dispersing apparatus is preferably used.

In use of the high-speed shearing dispersing apparatus, the working conditions such as rotating speed, dispersion time and dispersion temperature may be appropriately selected depending on the intended purpose.

The rotating speed is not particularly limited and may be appropriately selected depending on the intended purpose. It is preferably 1,000 rpm to 30,000 rpm, more preferably 5,000 rpm to 20,000 rpm.

The dispersion time is not particularly limited and may be appropriately selected depending on the intended purpose. When a batch method is employed, it is preferably 0.1 min to 5 min.

The dispersion temperature is not particularly limited and may be appropriately selected depending on the intended purpose. Under a pressurized state, it is preferably 0° C. to 150° C., more preferably 40° C. to 98° C. In general, the dispersion is easily performed at higher dispersion temperature.

The amount of the aqueous medium used in the emulsifying or dispersing the toner materials is not particularly limited and may be appropriately selected depending on the intended purpose. It is preferably 50 parts by mass to 2,000 parts by mass, 100 parts by mass to 1,000 parts by mass, per 100 parts by mass of the toner materials.

When the amount of the aqueous medium is less than 50 parts by mass, the toner materials cannot be sufficiently dispersed, resulting in failure to form toner base particles having a predetermined particle diameter. Meanwhile, use of the aqueous medium more than 2,000 parts by mass may elevate production cost.

In emulsifying or dispersing the oil phase containing the toner materials, a dispersing agent is preferably used in order for dispersoids (e.g., oil droplets) to be stabilized, to have a desired shape and to have a sharp particle size distribution.

The dispersing agent is not particularly limited and may be appropriately selected depending on the intended purpose. Examples thereof include a surfactant, a poorly water-soluble inorganic compound dispersing agent and a polymeric protective colloid. These may be used alone or in combination.

Among them, a surfactant is preferred.

The surfactant is not particularly limited and may be appropriately selected depending on the intended purpose. Examples thereof include an anionic surfactant, a cationic surfactant, a nonionic surfactant and an amphoteric surfactant.

The anionic surfactant is not particularly limited and may be appropriately selected depending on the intended purpose. Examples thereof include alkylbenzenesulfonic acid salts, α-olefin sulfonic acid salts and phosphoric acid esters.

Among them, fluoroalkyl group-containing compounds are preferred.

A catalyst may be used in the elongating reaction and/or crosslinking reaction for forming the adhesive base.

The catalyst is not particularly limited and may be appropriately selected depending on the intended purpose. Examples thereof include dibutyltinlaurate and dioctyltinlaurate.

—Removal of Organic Solvent—

The method for removing the organic solvent from the dispersion liquid such as the emulsified slurry is not particularly limited and may be appropriately selected depending on the intended purpose. Examples thereof include a method in which the entire system is gradually increased in temperature to evaporate off the organic solvent and a method in which the dispersion liquid is sprayed into a dry atmosphere to evaporate off the organic solvent contained in the oil droplets.

After the organic solvent has been removed, toner base particles are obtained. The toner base particles may be subjected to, for example, washing and drying, and further may be subjected to, for example, classification. The classification may be performed by removing fine particles with a cyclone, a decanter or a centrifuge. The classification may be performed after drying.

The obtained toner base particles may be mixed with particles such as the external additive and charge controlling agent. Here, a mechanical impact may be applied to the mixture for preventing such particles from dropping off from the surfaces of the toner base particles.

The method for applying a mechanical impact is not particularly limited and may be appropriately selected depending on the intended purpose. Examples thereof include a method in which an impact is applied to the mixture using a high-speed rotating blade, and a method in which an impact is applied by putting mixed particles into a high-speed air flow and accelerating the air speed such that the particles collide against one another or that the particles are crashed into a proper collision plate.

The apparatuses used in these methods are not particularly limited and may be appropriately selected depending on the intended purpose. Examples thereof include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

(Developer)

A developer of the present invention contains at least the above-described toner; and, if necessary, further contains appropriately selected other ingredients such as a carrier.

Thus, this developer is excellent in, for example, transferability and chargeability and can stably form high-quality images. Notably, the developer may be a one-component developer or a two-component developer. However, the latter is preferred when used in, for example, high-speed printers responding to the recent improvements in data processing, since the service life of the developer is prolonged.

The developer used as the one-component developer less changes in particle diameter of the toner particles even after the toner particles are consumed and supplied repeatedly. The one-component developer does not cause filming of the toner on a developing roller or fusion of the toner on a member for thinning a toner layer (e.g., a blade). The one-component developer can exhibit good, stable developability and image even when stirred for a long period of time.

The developer used as the two-component developer less changes in particle diameter of the toner particles even after the toner particles are consumed and supplied repeatedly. The two-component developer can exhibit good, stable developability and image even when stirred for a long period of time.

When using the toner as the two-component developer, the toner may be mixed with the carrier. The amount of the carrier contained in the two-component developer is not particularly limited and may be appropriately selected depending on the intended purpose. It is preferably 90% by mass to 98% by mass, more preferably 93% by mass to 97% by mass.

<Carrier>

The carrier is not particularly limited and may be appropriately selected depending on the intended purpose. The carrier preferably has a core material and a resin layer coating the core material.

—Core Material—

The material of the core material is not particularly limited and may be appropriately selected depending on the intended purpose. For example, it is preferable to employ manganese-strontium materials of 50 emu/g to 90 emu/g or manganese-magnesium materials of 50 emu/g to 90 emu/g. Further, it is preferably to employ high magnetization materials such as iron powder of 100 emu/g or more or magnetite of 75 emu/g to 120 emu/g for the purpose of securing image density. Moreover, it is preferably to employ low magnetization materials such as copper-zinc of 30 emu/g to 80 emu/g because the impact toward the photoconductor having the developer in the form of magnetic brush can be relieved and because it is advantageous for higher image quality.

These materials may be used alone or in combination.

The volume average particle diameter of the core materials is not particularly limited and may be appropriately selected depending on the intended purpose. It is preferably 10 μm to 150 μm, more preferably 40 μm to 100 μm. When the volume average particle diameter thereof is less than 10 μm, the amount of fine powder increases in the carrier, whereas magnetization per particle decreases and carrier scattering may occur. When it is greater than 150 μm, the specific surface area of the carrier decreases and thus toner scattering may occur. As a result, in the case of printing a full-color image having many solid portions, especially the reproduction of the solid portions may decrease.

—Resin Layer—

The material of the resin layer is not particularly limited and may be appropriately selected from known resins depending on the intended purpose. Examples thereof include amino-based resins, polyvinyl-based resins, polystyrene-based resins, polyhalogenated olefins, polyester-based resins, polycarbonate-based resins, polyethylenes, polyvinyl fluorides, polyvinylidene fluorides, polytrifluoroethylenes, polyhexafluoropropylenes, copolymers formed of vinylidene fluoride and an acrylic monomer, copolymers formed of vinylidene fluoride and vinyl fluoride, fluoroterpolmers such as copolymers formed of tetrafluoroethylene, vinylidene fluoride and a fluoro group-free monomer, and silicone resins.

These may be used alone or in combination.

The amino-based resins are not particularly limited and may be appropriately selected depending on the intended purpose, and examples thereof include urea-formaldehyde resins, melamine resins, benzoguanamine resins, urea resins, polyamide resins and epoxy resins.

The polyvinyl-based resins are not particularly limited and may be appropriately selected depending on the intended purpose, and examples thereof include acrylic resins, polymethyl mathacrylates, polyacrylonitriles, polyvinyl acetates, polyvinyl alcohols and polyvinyl butyrals.

The polystyrene-based resins are not particularly limited and may be appropriately selected depending on the intended purpose, and examples thereof include polystyrene and styrene-acrylic copolymers.

The polyhalogenated olefins are not particularly limited and may be appropriately selected depending on the intended purpose, and examples thereof include polyvinyl chloride.

The polyester resins are not particularly limited and may be appropriately selected depending on the intended purpose, and examples thereof include polyethylene terephthalates and polybutylene terephthalate.

If necessary, the resin layer may further contain, for example, conductive powder. The material for the conductive powder is not particularly limited and may be appropriately selected depending on the intended purpose, and examples thereof include metals, carbon black, titanium oxide, tin oxide and zinc oxide. The average particle diameter of the conductive powder is preferably 1 μm or smaller. When the average particle diameter is in excess of 1 μm, electrical resistance may be difficult to control.

The resin layer may be formed, for example, as follows. Specifically, a silicone resin, etc. are dissolved in a solvent to prepare a coating liquid, and then the thus-prepared coating liquid is applied onto the core surface with a known coating method, followed by drying and then baking.

The coating method is not particularly limited and may be appropriately selected depending on the intended purpose, and examples thereof include immersion coating methods, spray methods and brush coating methods.

The solvent is not particularly limited and may be appropriately selected depending on the intended purpose. Examples thereof include toluene, xylene, methyl ethyl ketone, methyl isobutyl ketone and butyl cellosolve acetate.

The baking method may be an external or internal heating method. Examples of the apparatus for the baking include methods employing a fixed-type electric furnace, a fluid-type electric furnace, a rotary electric furnace or a burner furnace; and methods employing microwave radiation.

The amount of the resin layer contained in the carrier is not particularly limited and may be appropriately selected depending on the intended purpose. It is preferably 0.01% by mass to 5.0% by mass on the basis of the total amount of the carrier. When the amount is less than 0.01% by mass, a uniform resin layer may not be formed on the surface of a carrier. Whereas when the amount is more than 5.0% by mass, the formed resin layer becomes too thick to cause adhesion between carrier particles, potentially resulting in failure to form uniform carrier particles.

EXAMPLES

The present invention will next be described by way of Examples, which should not be construed as limiting the present invention thereto. Unless otherwise specified, the unit "part(s)" means "part(s) by mass" and the unit "%" means "% by mass."

Production Example 1-1

Synthesis of Crystalline Polyester Resin A

A 5 L four-neck flask equipped with a nitrogen-introducing pipe, a drainpipe, a stirrer and a thermocouple was charged with 1,10-decanedicarboxylic acid (2,120 g), 1,10-decanediol (1,800 g) and hydroquinone (3.9 g), followed by reaction at 180° C. for 10 hours. Thereafter, the reaction mixture was allowed to react at 200° C. for 3 hours and further react at 8.3 kPa for 2 hours, to thereby produce crystalline polyester resin A.

Through GPC measurement of o-dichlorobenzen soluble matter of the crystalline polyester resin A, the Mw was found to be 16,000, the Mn was found to be 5,000, and the Mw/Mn was found to be 3.2.

Production Example 1-2

Synthesis of Crystalline Polyester Resin B

A 5 L four-neck flask equipped with a nitrogen-introducing pipe, a drainpipe, a stirrer and a thermocouple was charged with 1,8-octanedicarboxylic acid (2,120 g), 1,8-octanediol (1,000 g), 1,4-butanediol (1,520 g) and hydroquinone (3.9 g), followed by reaction at 180° C. for 10 hours. Thereafter, the reaction mixture was allowed to react at 200° C. for 3 hours and further react at 8.3 kPa for 2 hours, to thereby produce crystalline polyester resin B.

Through GPC measurement of o-dichlorobenzen soluble matter of the crystalline polyester resin B, the Mw was found to be 15,000, the Mn was found to be 5,000, and the Mw/Mn was found to be 3.0.

Production Example 1-3

Synthesis of Crystalline Polyester Resin C

A 5 L four-neck flask equipped with a nitrogen-introducing pipe, a drainpipe, a stirrer and a thermocouple was charged with maleic acid (1,120 g), succinic acid (1,140 g), 1,4-butanediol (960 g), 1,5-heptanediol (500 g), 1,6-hexanediol (550 g) and hydroquinone (3.9 g), followed by reaction at 180° C. for 10 hours. Thereafter, the reaction mixture was allowed to react at 200° C. for 3 hours and further react at 8.3 kPa for 2 hours, to thereby produce crystalline polyester resin C.

Through GPC measurement of o-dichlorobenzen soluble matter of the crystalline polyester resin A, the Mw was found to be 6,200, the Mn was found to be 1,400, and the Mw/Mn was found to be 4.4.

Production Example 2-1

Synthesis of Non-Crystalline Polyester Resin A

A 5 L four-neck flask equipped with a nitrogen-introducing pipe, a drainpipe, a stirrer and a thermocouple was charged with bisphenol A ethylene oxide 2 mole adduct (229 parts), bisphenol A propylene oxide 3 mole adduct (529 parts), isophthalic acid (100 parts), terephthalic acid (88 parts), adipic acid (66 parts) and dibutyltin oxide (2 parts). The reaction mixture was allowed to react under normal pressure at 230° C. for 10 hours and further react under a reduced pressure of 10 mmHg to 15 mmHg for 5 hours. Then, trimellitic anhydride (30 parts) was added to the reaction container, followed by reaction at 180° C. under normal pressure for 3 hours, to thereby produce non-crystalline polyester resin A.

The non-crystalline polyester resin A was found to have a weight average molecular weight of 6,500, a number average molecular weight of 2,000, a Tg of 45° C., and an acid value of 20 mgKOH/g.

Production Example 2-2

Synthesis of Non-Crystalline Polyester Resin B

A 5 L four-neck flask equipped with a nitrogen-introducing pipe, a drainpipe, a stirrer and a thermocouple was charged with bisphenol A ethylene oxide 2 mole adduct (499 parts), bisphenol A propylene oxide 3 mole adduct (229 parts), isophthalic acid (100 parts), terephthalic acid (48 parts), adipic acid (108 parts) and dibutyltin oxide (2 parts). The reaction mixture was allowed to react under normal pressure at 230° C. for 10 hours and further react under a reduced pressure of 10 mmHg to 15 mmHg for 5 hours. Then, trimellitic anhydride (30 parts) was added to the reaction container, followed by reaction at 180° C. under normal pressure for 3 hours, to thereby produce non-crystalline polyester resin B.

The non-crystalline polyester resin B was found to have a weight average molecular weight of 12,000, a number average molecular weight of 3,500, a Tg of 42° C., and an acid value of 20 mgKOH/g.

Example 1

Preparation of Toner 1

—Preparation of Crystalline Polyester Resin Dispersion Liquid—

The crystalline polyester resin A (100 parts), crystal nucleating agent A (n-stearylstearic acid amide, product of Nippon Kasei Chemical Co., Ltd., NIKKA AMIDE 5) (10 parts) and ethyl acetate (200 parts) were added to a 2 L metal container. The resultant mixture was dissolved at 75° C. under heating and then quenched in an ice-water bath at a temperature decreasing rate of 27° C./min. Subsequently, glass beads (3 mm in diameter) (500 mL) were added to the mixture, followed by pulverizing for 10 hours with a batch-type sand mill (product of Kanpe Hapio Co., Ltd.), to thereby obtain crystalline polyester resin dispersion liquid 1.

—Preparation of Oil Phase—

—Synthesis of Prepolymer—

A reaction container equipped with a condenser, a stirrer and a nitrogen-introducing pipe was charged with bisphenol A ethylene oxide 2 mole adduct (682 parts), bisphenol A propylene oxide 2 mole adduct (81 parts), terephthalic acid (283 parts), trimellitic anhydride (22 parts) and dibutyltin oxide (2 parts). The resultant mixture was allowed to react under normal pressure at 230° C. for 8 hours and further react at a reduced pressure of 10 mmHg to 15 mmHg for 5 hours, to thereby produce [intermediate polyester 1]. The [intermediate polyester 1] was found to have a number average molecular weight of 2,100, a weight average molecular weight of 9,500, a Tg of 55° C., an acid value of 0.5 mgKOH/g, and a hydroxyl value of 51 mgKOH/g.

Next, a reaction container equipped with a condenser, a stirrer and a nitrogen-introducing pipe was charged with 410 parts of the [intermediate polyester 1], 89 parts of isophorone diisocyanate and 500 parts of ethyl acetate, followed by reaction at 100° C. for 5 hours, to thereby produce [prepolymer 1]. The amount of free isocyanate contained in the [prepolymer 1] was found to be 1.53%.

—Synthesis of Ketimine—

A reaction container to which a stirring rod and a thermometer had been set was charged with isophorone diamine (170 parts) and methyl ethyl ketone (75 parts), followed by reaction at 50° C. for 5 hours, to thereby produce [ketimine compound 1]. The amine value of [ketimine compound 1] was found to be 418.

—Preparation of Masterbatch (Mb)—

Water (1,200 parts), carbon black (Printex35, product of Degussa) [DBP oil absorption amount=42 mL/100 mg, pH=9.5] (540 parts) and the non-crystalline polyester resin A (1,200 parts) were mixed together with HENSCHEL MIXER (product of Mitusi Mining Co.). The resultant mixture was kneaded at 150° C. for 30 min with a two-roller mill, and then rolled, cooled and pulverized with a pulverizer, to thereby produce [masterbatch 1].

—Preparation of Pigment—Wax Dispersion Liquid—

A container to which a stirring rod and a thermometer had been set was charged with the [non-crystalline polyester resin A] (378 parts), paraffin wax serving as releasing agent 1 (product of NIPPON SEIRO CO., LTD., HNP-9, hydrocarbon wax, melting point: 75° C., SP value: 8.8) (50 parts), CCA (salycilic acid metal complex E-84: product of Orient Chemical Industries, Ltd.) (22 parts) and ethyl acetate (947 parts), and the mixture was heated to 80° C. under stirring. The resultant mixture was maintained at 80° C. for 5 hours and then cooled to 30° C. over 1 hour. Subsequently, the [masterbatch 1] (500 parts) and ethyl acetate (500 parts) were charged into the container, followed by mixing for 1 hour, to thereby prepare [raw material solution 1].

The [raw material solution 1] (1,324 parts) was placed in a container and dispersed with a beads mill (ULTRA VISCOMILL, product of AIMEX CO., Ltd.) under the following conditions: a liquid feed rate of 1 kg/hr, disc circumferential velocity of 6 m/s, 0.5 mm-zirconia beads packed in 80% by volume, and 3 passes. Next, a 65% by mass ethyl acetate solution of the [non-crystalline polyester resin A] (1,042.3 parts) was added thereto, and passed once with the beads mill under the above conditions, to thereby obtain [pigment/WAX dispersion liquid 1]. The solid content of the [pigment/WAX dispersion liquid 1] was found to be 50% by mass (130° C., 30 min).

—Preparation of Oil Phase—

A container was charged with the [pigment.WAX dispersion liquid 1] (664 parts), the [prepolymer 1] (80 parts), the [crystalline polyester resin dispersion liquid 1] (150 parts) and the [ketimine compound 1] (4.6 parts). The resultant mixture was mixed for 1 min at 5,000 rpm using a TK homomixer (product of Tokushu Kika Kogyo Co., Ltd.), to thereby obtain [oil phase 1].

—Preparation of Fine Organic Particle Emulsion (Fine Particle Dispersion Liquid)—

A reaction container to which a stirring rod and a thermometer had been set was charged with 683 parts of water, 11 parts of a sodium salt of sulfate of an ethylene oxide adduct of methacrylic acid (Eleminol RS-30, product of Sanyo Chemical Industries, Ltd.), 138 parts of styrene, 138 parts of methacrylic acid and 1 part of ammonium persulfate. The resultant mixture was stirred at 400 rpm for 15 min to prepare a white emulsion. The white emulsion was then heated to 75° C., followed by reaction for 5 hours. Next, 30 parts of a 1% by mass aqueous ammonium persulfate solution was added to the reaction mixture, and the resultant mixture was aged at 75° C. for 5 hours, to thereby obtain an aqueous dispersion liquid [fine particle dispersion liquid 1] of a vinyl resin (copolymer of styrene-methacrylic acid-sodium salt of sulfate of an ethylene oxide adduct of methacrylic acid). Through measurement with LA-920 (product of HORIBA Co.), the [fine particle dispersion liquid 1] was found to have a volume average particle diameter of 0.14 μm. Part of the [fine particle dispersion liquid 1] was dried to insolate resin.

—Preparation of Aqueous Phase—

Water (990 parts), [fine particle dispersion liquid 1] (83 parts), a 48.5% by mass aqueous solution of sodium dodecyldiphenyl ether disulfonate (ELEMINOL MON-7, product of Sanyo Chemical Industries Ltd.) (37 parts) and ethyl acetate (90 parts) were mixed together and stirred to obtain an opaque white liquid, which was used as [aqueous phase 1].

—Emulsification.Desolvation—

A container in which the [oil phase 1] had been placed was charged with the [aqueous phase 1] (1,200 parts), and the resultant mixture was mixed with a TK homomixer at 13,000 rpm for 20 min, to thereby obtain [emulsified slurry 1].

The [emulsified slurry 1] was added to a container to which a stirrer and a thermometer had been set, and dessolvated at 30° C. for 8 hours and then aged at 45° C. for 4 hours, to thereby obtain [dispersion slurry 1].

—Washing.Drying—

The [dispersion slurry 1] (100 parts) was filtrated under reduced pressure and then subjected twice to a series of treatments (1) to (4) described below, to thereby obtain [filtration cake 1]:

(1): ion-exchanged water (100 parts) was added to the filtration cake, followed by mixing with a TK homomixer (at 12,000 rpm for 10 min) and then filtration;

(2): 10% by mass aqueous sodium hydroxide solution (100 parts) was added to the filtration cake obtained in (1), followed by mixing with a TK homomixer (at 12,000 rpm for 30 min) and then filtration under reduced pressure;

(3): 10% by mass hydrochloric acid (100 parts) was added to the filtration cake obtained in (2), followed by mixing with a TK homomixer (at 12,000 rpm for 10 min) and then filtration; and (4): ion-exchanged water (300 parts) was added to the filtration cake obtained in (3), followed by mixing with a TK homomixer (at 12,000 rpm for 10 min) and then filtration.

The [filtration cake 1] was dried with an air-circulating drier at 45° C. for 48 hours, and then was caused to pass through a sieve with a mesh size of 75 μm, to thereby prepare [toner 1].

Example 2

The procedure of Example 1 was repeated, except that the crystal nucleating agent A in —Preparation of crystalline polyester resin dispersion liquid— was changed to crystal nucleating agent B (ethylene glycol dibehenate, product of Matsumoto Yushi Co., B-DB60), to thereby produce a toner of Example 2.

Example 3

The procedure of Example 1 was repeated, except that the crystal nucleating agent A in —Preparation of crystalline polyester resin dispersion liquid— was changed to crystal nucleating agent C (ethylene bisoleic acid amide, product of Nippon Kasei Chemical Co., Ltd., SLIPAX O), to thereby produce a toner of Example 3.

Example 4

The procedure of Example 1 was repeated, except that, in —Preparation of crystalline polyester resin dispersion liquid—, the crystalline polyester A was changed to the crystalline polyester B and the crystal nucleating agent A was changed to crystal nucleating agent D (stearylstearic acid, product of NOF CORPORATION), to thereby obtain a toner of Example 4.

Example 5

The procedure of Example 1 was repeated, except that the crystalline polyester A was changed to the crystalline polyester C in —Preparation of crystalline polyester resin dispersion liquid—, to thereby obtain a toner of Example 5.

Example 6

The procedure of Example 1 was repeated, except that the crystal nucleating agent A in —Preparation of crystalline polyester resin dispersion liquid— was changed to crystal nucleating agent E (ethylene bisstearic acid amide, product of Nippon Kasei Chemical Co., Ltd., BISAMIDE LA), to thereby produce a toner of Example 6.

Example 7

The procedure of Example 1 was repeated, except that the crystal nucleating agent A in —Preparation of crystalline polyester resin dispersion liquid— was changed to crystal nucleating agent F (oleic acid amide, product of Nippon Fine Chemical Co., NEUTRON), to thereby produce a toner of Example 7.

Example 8

The procedure of Example 1 was repeated, except that the non-crystalline polyester A was changed to the non-crystalline polyester B and that the amount of the [prepolymer 1] in —Preparation of oil phase— was changed from 80 parts to 0 parts, to thereby obtain a toner of Example 8.

Example 9

The procedure of Example 1 was repeated, except that the crystal nucleating agent A in —Preparation of crystalline polyester resin dispersion liquid— was changed to crystal nucleating agent H (ethanol amine distearate, product of Nippon Kasei Chemical Co., Ltd., SLIAID S), to thereby produce a toner of Example 9.

Comparative Example 1

The procedure of Example 1 was repeated, except that the amount of the crystal nucleating agent A was changed from 10 parts to 0 parts in —Preparation of crystalline polyester resin dispersion liquid—, to thereby produce a toner of Comparative Example 1.

Comparative Example 2

The procedure of Example 1 was repeated, except that the crystal nucleating agent A in —Preparation of crystalline polyester resin dispersion liquid— was changed to crystal nucleating agent H (behenyl behenate, product of CHUKYO YUSHI CO., LTD., N-252), to thereby produce a toner of Comparative Example 2.

Comparative Example 3

The procedure of Example 1 was repeated, except that, in —Preparation of crystalline polyester resin dispersion liquid—, the crystalline polyester A was changed to the crystalline polyester resin C and the crystal nucleating agent A was changed to the crystal nucleating agent B (ethylene glycol dibehenate, product of Matsumoto Yushi Co., B-DB60), to thereby obtain a toner of Comparative Example 3.

Comparative Example 4

The procedure of Example 1 was repeated, except that the crystal nucleating agent A in —Preparation of crystalline polyester resin dispersion liquid— was changed to crystal nucleating agent I (ethylene bislauric acid amide, Nippon Kasei Chemical Co., Ltd., SLIPAX O), to thereby produce a toner of Comparative Example 4.

Comparative Example 5

The procedure of Example 1 was repeated, except that the crystal nucleating agent A in —Preparation of crystalline polyester resin dispersion liquid— was changed to crystal nucleating agent J (N-oleyllauric acid amide, Nippon Kasei Chemical Co., Ltd., NIKKA AMIDE OL), to thereby produce a toner of Comparative Example 5.

Comparative Example 6

The procedure of Example 1 was repeated, except that the crystal nucleating agent A in —Preparation of crystalline polyester resin dispersion liquid— was changed to crystal nucleating agent K (N-stearyloleic acid amide, Nippon Kasei Chemical Co., Ltd., NIKKA AMIDE SO), to thereby produce a toner of Comparative Example 6.

The following Table 1 shows the materials of the toners produced in Examples 1 to 9 and Comparative Examples 1 to 6.

TABLE 1

| | Crystalline polyester resin | Non-crystalline polyester resin | Crystal nucleating agent | Prepolymer |
|---|---|---|---|---|
| Ex. 1 | A | A | A | A |
| Ex. 2 | A | A | B | A |
| Ex. 3 | A | A | C | A |
| Ex. 4 | B | A | D | A |
| Ex. 5 | C | A | A | A |
| Ex. 6 | A | A | E | A |
| Ex. 7 | A | A | F | A |
| Ex. 8 | A | B | A | — |
| Ex. 9 | A | A | G | A |
| Comp. Ex. 1 | A | A | — | A |
| Comp. Ex. 2 | A | A | H | A |
| Comp. Ex. 3 | C | A | B | A |
| Comp. Ex. 4 | A | A | I | A |
| Comp. Ex. 5 | A | A | J | A |
| Comp. Ex. 6 | A | A | K | A |

The following Table 2 shows various properties of the materials used in Examples and Comparative Example: the exothermic peak temperature (Tp [° C.]) of the crystalline polyester resin; the exothermic peak temperature (Tc [° C.]) of the crystal nucleating agent; the exothermic peak temperature (Tm [° C.]) of the mixture containing the crystalline polyester resin and the crystal nucleating agent; the melting point (Mp [° C.]) of the crystalline polyester resin; the melting point (Mc [° C.]) of the crystal nucleating agent; the solubility at 70° C. (S70) of the crystal nucleating agent to ethyl acetate; and the solubility 25° C. (S25) of the crystal nucleating agent to ethyl acetate.

Notably, the exothermic peak temperature and the melting point were measured with a DSC system (a differential scanning calorimeter) ("DSC-60," product of Shimadzu Corporation) according to the procedure described herein. The melting point of the crystalline polyester resin and the crystal nucleating agent was obtained from the DSC curve at the second temperature raising of the target sample.

TABLE 2

| | Tp | Tc | Tm | Mp | Mc | S70 | S25 | (Tc-Tp) | (Tm-Tp) |
|---|---|---|---|---|---|---|---|---|---|
| Ex. 1 | 52 | 80 | 62 | 70 | 90 | 10 | 0.2 | 18 | 8 |
| Ex. 2 | 52 | 70 | 56 | 70 | 76 | 10 | 0.3 | 8 | 2 |
| Ex. 3 | 52 | 105 | 65 | 70 | 125 | 10 | 0.1 | 43 | 11 |
| Ex. 4 | 46 | 58 | 54 | 60 | 66 | 10 | 0.2 | 2 | 6 |
| Ex. 5 | 68 | 80 | 75 | 80 | 90 | 10 | 0.2 | 2 | 5 |
| Ex. 6 | 52 | 110 | 60 | 70 | 140 | 2 | 0.1 | 48 | 6 |
| Ex. 7 | 52 | 65 | 60 | 70 | 80 | 10 | 0.6 | 3 | 6 |
| Ex. 8 | 52 | 80 | 62 | 70 | 90 | 10 | 0.2 | 18 | 8 |
| Ex. 9 | 52 | 75 | 55 | 70 | 82 | 10 | 0.2 | 13 | 1 |
| Comp. Ex. 1 | 52 | — | — | 70 | — | — | — | — | — |
| Comp. Ex. 2 | 52 | 75 | 52 | 70 | 80 | 10 | 0.2 | 13 | −2 |
| Comp. Ex. 3 | 68 | 70 | 69 | 80 | 80 | 10 | 0.3 | −8 | −1 |
| Comp. Ex. 4 | 52 | 152 | 58 | 70 | 155 | 1 | 0.1 | 90 | 4 |
| Comp. Ex. 5 | 52 | 56 | 51 | 70 | 58 | 10 | 10 | −6 | −3 |
| Comp. Ex. 6 | 52 | 61 | 55 | 70 | 65 | 10 | 0.3 | −1 | 1 |

<Evaluation>

The produced toners were used to prepare developers with the following methods, and the developers were evaluated for the following properties. The results are shown in Table 3.

<<Preparation of Developer>>

Silicone resin (organo straight silicone) (100 parts), γ-(2-aminoethyl)aminopropyl trimethoxysilane (5 parts) and carbon black (10 parts) were added to toluene (100 parts). The resultant mixture was dispersed for 20 min with a Homomixer to prepare a coating layer forming liquid. The coating layer forming liquid was coated on the surface of spherical magnetite particles having an average particle diameter of 50 μm (1,000 parts by mass) using a fluid bed coating apparatus, to thereby prepare a carrier.

—Preparation of Developer—

Each (5 parts) of the toner 1 was mixed with the carrier (95 parts) using a ball mill, to thereby prepare a developer.

<<Low Temperature Fixability and Hot Offset Resistance>>

A fixing portion of the copier MF-2200 (product of Ricoh Company, Ltd.) employing a TEFLON (registered trade mark) roller as a fixing roller was modified to produce a modified copier. This modified copier was used to perform a printing test using Type 6200 paper sheets (product of Ricoh Company, Ltd.).

Specifically, printing was performed with changing the fixing temperature, to thereby determine a cold offset temperature (minimum fixing temperature) and a hot offset temperature (maximum fixing temperature).

The evaluation conditions employed for determining the minimum fixing temperature were set as follows: paper-feeding linear velocity: 120 mm/s to 150 mm/s, surface pressure: 1.2 kgf/cm$^2$, and nip width: 3 mm.

The evaluation conditions employed for determining the maximum fixing temperature were set as follows: paper-feeding linear velocity: 50 mm/s, surface pressure: 2.0 kgf/cm$^2$, and nip width: 4.5 mm.

The minimum fixing temperature of 110° C. or lower is not practically problematic. The maximum fixing temperature of 170° C. or higher is not practically problematic. In addition, the fixing temperature range of 60° C. or higher is not practically problematic.

<<Heat Resistance Storage Stability>>

After having been stored at 50° C. for 8 hours, the toner was sieved with a metal sieve having an aperture of 42 mesh for 2 min. Then, the toner remaining on the metal sieve (residual rate) was measured. Here, the less the residual rate of the toner is, the better the heat resistant storage stability of the toner is.

Notably, the following criteria were employed for the evaluation.

A: Residual rate<10%

B: 10%≤Residual rate<20%

C: 20%≤Residual rate<30%

D: 30%≤Residual rate

<<Image Blocking Property>>

A fixing portion of the copier MF-2200 (product of Ricoh Company, Ltd.) employing a TEFLON (registered trade mark) roller as a fixing roller was modified to produce a modified copier. This modified copier was used to perform a printing test using Type 6200 paper sheets (product of Ricoh Company, Ltd.).

Specifically, the printing test was performed with a fixing temperature being set to a temperature of (20° C.+minimum fixing temperature which had been measured for low temperature fixability) under the following conditions: paper-feeding linear velocity: 120 mm/s to 150 mm/s, surface pressure: 1.2 kgf/cm$^2$, and nip width: 3 mm.

The fixed image obtained was superposed on a blank paper sheet, and they were sandwiched between metal plates, followed by application of a load (pressure) of 10 kPa. The resultant product was stored at 50° C. for 24 hours, and then the image was peeled off from the black paper sheet to evaluate blocking property.

Notably, the image blocking property was evaluated according to the following evaluation criteria. Notably, ranks A and B means non-problematic practically, while ranks C and D means problematic practically.

A: The image was not transferred to the blank paper sheet at all, and no sound was generated upon peeling.

B: The image was not transferred to the blank paper sheet, but some sound was generated upon peeling.

C: Part of the image was transferred to the blank paper sheet, but most of the image remained.

D: The image adhered to the blank paper sheet, and the image was impaired when peeled off.

<<Fogging>>

Using the tandem-type color electrophotographic apparatus IMAGIO NEO 450 (product of Ricoh Company, Ltd.) having a cleaning blade and a charging roller each being provided so as to be in contact with a photoconductor, 10,000 copies of a laterally-set A4 chart (image pattern A) having a pattern formed by alternatingly repeating a 1 cm black solid portion and 1 cm white solid portion in a direction perpendicular to the rotating direction of the developing sleeve were printed out. Thereafter, a blank image was printed out, and the printed image was visually evaluated for fogging according to the following criteria.

<Evaluation Criteria>

A: No fogging was observed

B: Fogging was observed to such an extent that it involved no problems in practical use C: Fogging was observed to such an extent that it could involve problems in practical use D: Fogging was observed to such an extent that it involved great problems in practical use <<Filming>>

Printing of 10,000 images was performed using the image forming apparatus MF2800 (product of Ricoh Company, Ltd.), and then the photoconductor was visually observed and evaluated for adhesion of toner components, particularly the releasing agent, onto the photoconductor. The evaluation was based on the following criteria.

A: No adhesion of toner component onto photoconductor was observed

B: Adhesion of toner component onto photoconductor was observed to such an extent that it did not involve problems in practical use C: Adhesion of toner component onto photoconductor was observed to such an extent that it involved problems in practical use D: Adhesion of toner component onto photoconductor was observed to such an extent that it involved great problems in practical use The evaluation results are shown in Table 3.

TABLE 3

| | Tg1st | Tg2nd | Min. fixing temp. (° C.) | Max. fixing temp. (° C.) | Heat resistance storage stability | Image blocking property | Fogging | Filming |
|---|---|---|---|---|---|---|---|---|
| Ex. 1 | 52 | 25 | 100 | 190 | A | A | A | A |
| Ex. 2 | 50 | 23 | 100 | 185 | B | B | A | A |
| Ex. 3 | 55 | 28 | 105 | 195 | A | A | A | A |
| Ex. 4 | 48 | 28 | 95 | 180 | B | B | A | B |
| Ex. 5 | 52 | 24 | 110 | 200 | B | A | A | B |
| Ex. 6 | 50 | 20 | 105 | 180 | B | A | A | B |
| Ex. 7 | 48 | 20 | 100 | 175 | B | B | B | B |
| Ex. 8 | 45 | 25 | 95 | 170 | B | A | A | B |
| Ex. 9 | 50 | 25 | 100 | 180 | B | B | A | A |
| Comp. Ex. 1 | 42 | 13 | 100 | 155 | D | D | C | C |
| Comp. Ex. 2 | 45 | 15 | 100 | 160 | C | C | C | C |
| Comp. Ex. 3 | 48 | 20 | 110 | 170 | C | C | C | C |
| Comp. Ex. 4 | 52 | 30 | 110 | 170 | B | A | C | C |
| Comp. Ex. 5 | 45 | 25 | 100 | 170 | D | D | C | C |
| Comp. Ex. 6 | 50 | 25 | 100 | 170 | C | C | C | C |

As is clear from the evaluation results, Examples 1 to 9 of the present invention were found to produce toners and developers containing the toners, which involved no filming, were excellent in low temperature fixability, hot offset resistance and heat resistance storage stability, and provided blocking resistance in the fixed toner image. In contrast, any of Comparative Examples 1 to 6 could not produce toners or developers satisfying all desired properties.

This application claims priority to Japanese application Nos. 2011-011624, filed on Jan. 24, 2011, and 2011-260175, filed on Nov. 29, 2011, and incorporated herein by reference.

What is claimed is:

1. A toner comprising:

a binder resin component;

a crystal nucleating agent;

a releasing agent; and a colorant, wherein the binder resin component contains a crystalline polyester resin and a non-crystalline polyester resin, wherein the crystalline polyester resin has a melting point of 60° C. or higher but lower than 80° C., wherein the crystal nucleating agent is at least one selected from the group consisting of an aliphatic ester compound having a melting point of 60° C. or higher but lower than 120° C. and an aliphatic amide compound having a melting point of 60° C. or higher but lower than 120° C., and wherein the toner satisfies the following expressions (I) and (II):

$$Tc>Tp+10 \quad \text{Expression (I)}$$

$$Tm>Tp+2 \quad \text{Expression (II)}$$

where Tp denotes the lowest exothermic peak temperature [° C.] in a range of 0° C. to 200° C. in a differential scanning calorimetry (DSC) curve obtained through DSC of the crystalline polyester resin, Tc denotes the lowest exothermic peak temperature [° C.] in a range of 0° C. to 200° C. in a DSC curve obtained through DSC of the crystal nucleating agent, and Tm denotes the lowest exothermic peak temperature [° C.] in a range of 0° C. to 200° C. in a DSC curve obtained through DSC of the mixture of the crystalline polyester resin and the crystal nucleating agent, wherein the toner is obtained by a method comprising:

dispersing, in an aqueous medium, an oil phase containing the binder resin component, the crystal nucleating agent, the releasing agent and the colorant in an organic solvent, to prepare a dispersion liquid; and removing the organic solvent from the dispersion liquid.

2. The toner according to claim 1, wherein the toner satisfies the following expressions (I) and (II'):

$$Tc>Tp+10 \quad \text{Expression (I)}$$

$$Tm>Tp+5 \quad \text{Expression (II')}.$$

3. The toner according to claim 1, wherein the crystal nucleating agent is the aliphatic amide compound having a melting point of 60° C. or higher but lower than 120° C.

4. The toner according to claim 1, wherein a solubility at 70° C. of the crystal nucleating agent to the organic solvent is 5% by mass or more and a solubility at 25° C. of the crystal nucleating agent to the organic solvent is 0.5% by mass or less.

5. The toner according to claim 1, wherein the melting point of the crystal nucleating agent is 70° C. or higher but lower than 120° C.

6. The toner according to claim 1, wherein the crystalline polyester resin has a constituent unit derived from a saturated aliphatic dicarboxylic acid and a constituent unit derived from a saturated aliphatic diol.

7. The toner according to claim 1, wherein the toner has a glass transition temperature (Tg1st) of 20° C. or higher but lower than 60° C., where the glass transition temperature (Tg1st) is measured at the first temperature raising in DSC.

8. The toner according to claim 1, wherein the toner has a glass transition temperature (Tg2nd) of 10° C. or higher but lower than 30° C., where the glass transition temperature (Tg2nd) is measured at the second temperature raising in DSC.

9. The toner according to claim 1, wherein soluble matter of the crystalline polyester resin in o-dichlorobenzene has a weight average molecular weight (Mw) of 3,000 to 30,000, a number average molecular weight (Mn) of 1,000 to 10,000, and a ratio Mw/Mn of 1.0 to 10, where the weight average molecular weight (Mw) and the number average molecular weight (Mn) are measured through gel permeation chromatography (GPC).

10. The toner according to claim 1, wherein the method for obtaining the toner comprises:

preparing the oil phase by dissolving or dispersing, in an organic solvent, an active hydrogen group-containing compound serving as a precursor of the binder resin component, a polymer containing a site reactive with the active hydrogen group-containing compound serving as another precursor of the binder resin component, the crystalline polyester resin, the non-crystalline polyester resin, the crystal nucleating agent, the releasing agent and the colorant;

dispersing the oil phase in the aqueous medium to prepare the dispersion liquid and allowing, in the dispersion liquid, the active hydrogen group-containing compound and the polymer containing a site reactive with the active hydrogen group-containing compound to undergo crosslinking reaction or elongating reaction or both of the crosslinking reaction and the elongating reaction; and removing the organic solvent from the dispersion liquid.

11. A developer comprising:

the toner as claimed in claim 1.

12. The developer as claimed in claim 11, wherein the developer further comprises a carrier.

* * * * *